US008933768B2

(12) United States Patent
Richley et al.

(10) Patent No.: US 8,933,768 B2
(45) Date of Patent: Jan. 13, 2015

(54) STRUCTURES FOR REGISTRATION ERROR COMPENSATION

(71) Applicant: ZIH Corp., Lincolnshire, IL (US)

(72) Inventors: Edward A. Richley, Gaithersburg, MD (US); Sifen Luo, Potomac, MD (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 13/659,541

(22) Filed: Oct. 24, 2012

(65) Prior Publication Data

US 2013/0099878 A1 Apr. 25, 2013

Related U.S. Application Data

(60) Provisional application No. 61/551,295, filed on Oct. 25, 2011.

(51) Int. Cl.

| | |
|---|---|
| ***H01P 1/203*** | (2006.01) |
| ***H01P 7/08*** | (2006.01) |
| ***H01P 11/00*** | (2006.01) |

(52) U.S. Cl.

CPC ..... *H01P 1/203* (2013.01); *H01P 11/003* (2013.01); *H01P 1/20336* (2013.01); *H01P 7/082* (2013.01)

USPC ..... 333/204; 333/219

(58) Field of Classification Search

CPC ..... H01P 7/082; H01P 1/20336

USPC ..... 333/204, 205, 219, 235

See application file for complete search history.

(56) References Cited

U.S. PATENT DOCUMENTS

| | | | | |
|---|---|---|---|---|
| 2,751,558 | A * | 6/1956 | Engelmann et al. | 333/204 |
| 5,705,966 | A * | 1/1998 | Carmi | 333/219 |
| 2006/0250199 | A1 * | 11/2006 | Ohwada et al. | 333/204 |
| 2007/0080760 | A1 | 4/2007 | Alford | |

FOREIGN PATENT DOCUMENTS

FR 2 959 908 A1 11/2011

OTHER PUBLICATIONS

International Search Report and Written Opinion from International Application No. PCT/US2010/061808, mailed Jan. 25, 2013.

U.S. Appl. No. 61/551,295, filed Oct. 25, 2011, In re: Richley entitled *Structures for Registration Error Compensation*.

*Filters, Resonators and Custom Ceramic Components*, Catalog, Dielectric Laboratories, Mar. 2011, 28 pages.

*Short Form Frequency Clocks, Crystals and Oscillators*, CTS Electronic Components, Inc., Oct. 8, 2012, 14 pages.

* cited by examiner

*Primary Examiner* — Robert Pascal

*Assistant Examiner* — Gerald Stevens

(74) *Attorney, Agent, or Firm* — Alston & Bird LLP

(57) ABSTRACT

Metallization layer structures for reduced changes in radio frequency characteristics due to registration error and associated methods are provided herein. An example resonator includes a first conductive layer defining an error limiting feature and a second conductive layer. The resonator further includes at least one communication feature configured to electrically couple the first conductive layer and the second conductive layer at a communication position. The error limiting feature is configured to reduce changes in radio frequency characteristics of the resonator due to registration error. Methods of manufacturing resonators are also provided herein.

53 Claims, 19 Drawing Sheets

771

1171

STRUCTURES FOR REGISTRATION ERROR COMPENSATION

CROSS REFERENCE TO RELATED APPLICATIONS

The present application claims priority to U.S. Provisional Application No. 61/551,295 filed Oct. 25, 2011, entitled "Structures for Registration Error Compensation," the contents of which are hereby incorporated herein in its entirety by reference.

BACKGROUND

Radio frequency communication devices are often required to operate at precise frequencies (or within precise frequency bands) in order to efficiently achieve their intended communication purposes. Such devices are designed with radio frequency circuit components that are configured to facilitate communications at intended frequencies while limiting communications at undesired frequencies. For example, filters may be used in a variety of radio frequency communication devices to enable desired frequencies to pass through a radio frequency circuit while rejecting those frequencies that are not needed.

Applicant has identified a number of deficiencies and problems associated with the manufacture, use, and operation of conventional radio frequency communication devices. Through applied effort, ingenuity, and innovation, Applicant has solved many of these identified problems by developing a solution that is embodied by the present invention, which is described in detail below.

SUMMARY

Radio frequency communication devices that support the reception and/or transmission of higher frequency signals, such as signals at microwave frequencies, may be particularly sensitive to misalignment between constituent features. Such misalignments, which include registration errors, can affect the radio frequency characteristics of the devices. Registration errors, even when relatively small, can, in some instances, partially or completely nullify the functionality of a radio frequency device. As such, various example embodiments of the present invention are designed to reduce, limit, or eliminate the effects of registration errors on the performance or characteristics of radio frequency communication devices.

Radio frequency communication devices may include various radio frequency circuit components, such as a resonator. A resonator structured in accordance with one example embodiment may comprise a first conductive layer defining an error limiting feature and a second conductive layer. The resonator may further include at least one communication feature (e.g., a via) configured to electrically couple the first conductive layer and the second conductive layer at a communication position. The error limiting feature is configured to reduce changes in radio frequency characteristics of the resonator due to registration errors such as those which may occur during fabrication.

In some embodiments, the first conductive layer defines a first end, and the error limiting feature is defined by the first conductive layer between the communication position and the first end. In other embodiments, the second conductive layer defines a ground plane.

In still other embodiments, the first conductive layer comprises a first resonator element defining a first end and a first error limiting feature. The first conductive layer further comprises a second resonator element defining a first end and a second error limiting feature. The at least one communication feature comprises a first communication feature and a second communication feature. The first communication feature is configured to electrically couple the first resonator element to the ground plane at a first communication position. The first error limiting feature is defined by the first resonator element between the first communication position and the first end of the first resonator element. The second communication feature is configured to electrically couple the second resonator element to the ground plane at a second communication position. The second error limiting feature is defined by the second resonator element between the second communication position and the first end of the second resonator element.

Additionally, in some embodiments, the first conductive layer comprises a third resonator element defining a first end and a third error limiting feature. The at least one communication feature comprises a third communication feature. The third communication feature is configured to electrically couple the third resonator element to the ground plane at a third communication position. The third error limiting feature is defined by the third resonator element between the third communication position and the first end of the third resonator element.

In some embodiments, the first conductive layer defines a first end and an opposing second end, and a first lateral edge and an opposing second lateral edge. The error limiting feature of the first conductive layer defines an extension portion proximate the second end that extends laterally from the first lateral edge. The communication position is positioned on the extension portion.

Additionally, in some embodiments, the extension portion extends laterally from the first lateral edge and the second lateral edge. The at least one communication feature comprises a first communication feature and a second communication feature. The first communication feature is configured to electrically couple the first conductive layer to the second conductive layer at a first communication position. The second communication feature is configured to electrically couple the first conductive layer to the second conductive layer at a second communication position. The first communication position and the second communication position are positioned on the extension portion.

In still additional embodiments, the first communication position and the second communication position are positioned symmetrically in the lateral direction on the first conductive layer. Additionally or alternatively, the extension portion further defines at least one tab that extends longitudinally in at least one direction from an edge of the extension portion. The communication position is positioned at least partially on the at least one tab. Additionally or alternatively, the extension portion is defined such that a radiused transition exists between the extension portion and the first lateral edge of the first conductive layer.

In some embodiments, the first conductive layer defines a first end and an opposing second end. The error limiting feature defines a cut-out portion defining an area of the first conductive layer that has been removed. The communication position is positioned proximate the cut-out portion so as to form a deviation between the first end and the communication position. Additionally, in some embodiments, the cut-out portion defines a "U" shape.

In some embodiments, the first conductive layer comprises a resonator element, and wherein the second conductive layer comprises a ground plane. In some embodiments, the first conductive layer comprises three or more resonator elements arranged to form a filter.

In another example embodiment, a first conductive layer is provided. The first conductive layer defines an error limiting feature. The first conductive layer is configured to electrically couple with a second conductive layer through at least one communication feature at a communication position. The error limiting feature is configured to reduce changes in radio frequency characteristics of the resonator element due to registration error.

In yet another example embodiment, a method for manufacturing a resonator is provided. The method comprises providing a first conductive layer. The first conductive layer defines an error limiting feature configured to reduce changes in radio frequency characteristics of the resonator element due to registration error. The method further comprises providing a second conductive layer. The method further comprises forming at least one communication feature. The communication feature is configured to electrically couple the first conductive layer and the second conductive layer at a communication position.

In another example embodiment, a filter is provided. The filter includes a first resonator element defining a first error limiting feature configured to reduce changes in radio frequency characteristics of the first resonator element due to registration error. The filter further includes a second resonator element defining a second error limiting feature configured to reduce changes in radio frequency characteristics of the second resonator element due to registration error. The filter further includes a third resonator element defining a third error limiting feature configured to reduce changes in radio frequency characteristics of the third resonator element due to registration error.

In some embodiments, the first resonator element defines a first end and the first error limiting feature is defined by the first resonator element between a first communication position and the first end. The second resonator element defines a first end and the second error limiting feature is defined by the second resonator element between a second communication position and the first end. The third resonator element defines a first end and the third error limiting feature is defined by the third resonator element between a third communication position and the first end.

In some embodiments, the first resonator element defines a first port, wherein the third resonator element defines a second port. In some embodiments, the first resonator element defines a first end and an opposing second end. The first error limiting feature defines an extension portion that extends from the second end. The second resonator element defines a first end and an opposing second end. The second error limiting feature defines an extension portion that extends from the second end. The third resonator element defines a first end and an opposing second end. The third error limiting feature defines an extension portion that extends from the second end.

BRIEF DESCRIPTION OF THE DRAWING(S)

Reference will now be made to the accompanying drawings, which are not necessarily drawn to scale, and wherein.

DETAILED DESCRIPTION

Figure 1:
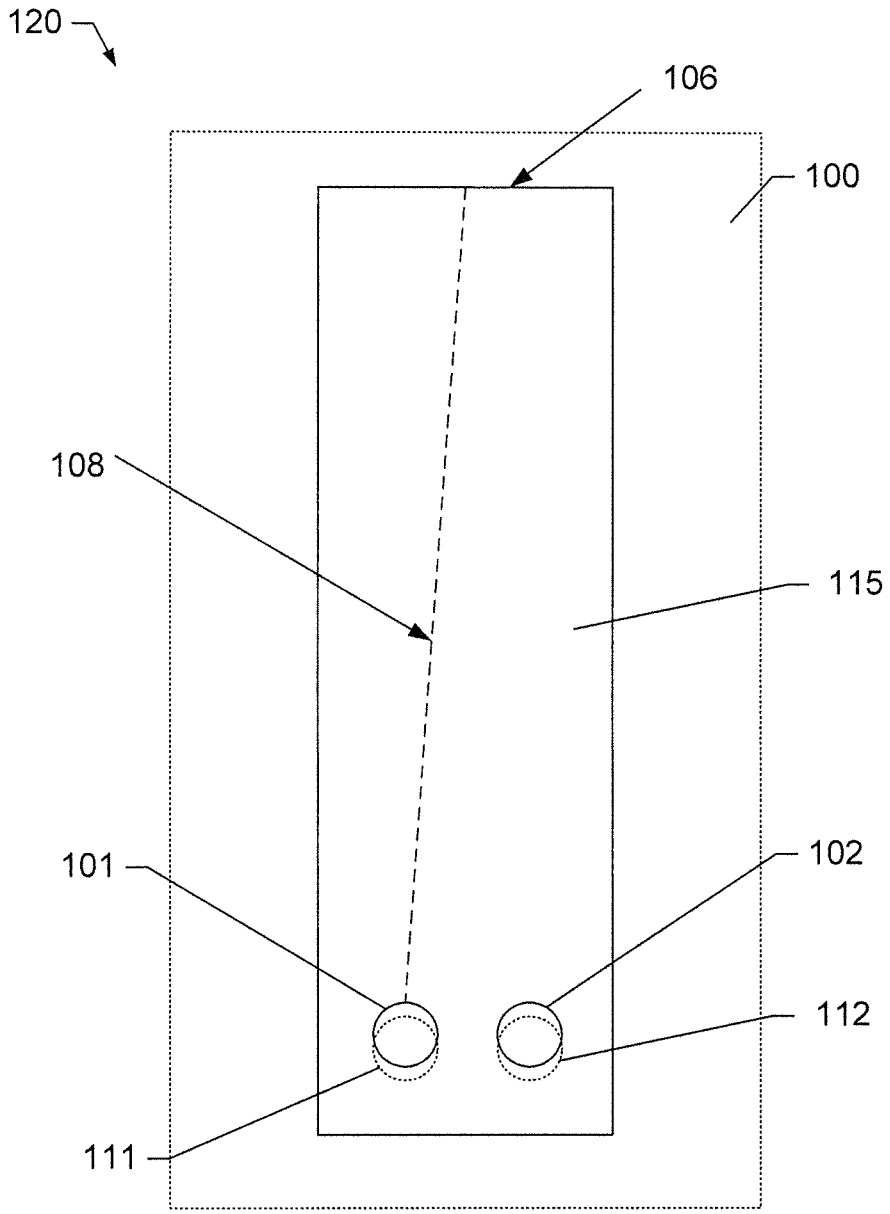
FIG. 1 PRIOR ART
FIG. 1 illustrates an example occurrence of registration error in a conventional resonator according to various example embodiments.

Example embodiments of the present invention will now be described hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

The construction of radio frequency devices (e.g., ultra-wide band (UWB) devices) may be based on planar fabrication in the form of, for example, microstrips, and the devices may define a resonator and be disposed on printed circuit boards (PCBs), thick films, or the like. The devices may be formed on planar substrates, where a number of different layers (e.g., top and bottom sides of a substrate and/or multiple substrates) are used. As used herein "resonator" may comprise any device or system that exhibits resonance or resonant behavior or provides an impedance matching or tuning function and may include one or more conductive layers. Such conductive layers may be formed from any number of structures (e.g., a resonator element, a ground plane, other metallization layer structures, etc.). Such metallization layer structures may be formed of any conductive material (e.g., copper, gold, etc.). The resonator may be formed of such structures being disposed on (or which define) different conductive layers that are aligned relative to each other during fabrication to achieve desired characteristics. Any misalignment of the structures and/or the communication features between the structures, such as vias of the structures, due to registration errors can cause undesirable changes in the radio frequency characteristics of the devices.

FIG. 1 illustrates one exemplary type of registration error that has been identified by Applicant as having a negative effect on the radio frequency characteristics of a radio frequency communication device. In particular, FIG. 1 depicts a resonator 120 comprised of an insulating substrate 100 sandwiched between a resonator element 115 (i.e., first conductive layer) and a ground plane (i.e., second conductive layer (not shown)). The resonator element 115 may be a metallized layer formed in any number of ways on the planar surface of the insulating substrate 100, such as by etching or the like. Such resonator element formation may be performed as a first operation in the fabrication of a resonator for a radio frequency device (e.g., an RF filter, antenna, or the like).

In some embodiments, often through a second operation, one or more communication features 101, 102 may be added to the resonator 120. The term "communication feature" as used herein may refer to any feature used to electrically couple (i.e., create electrical communication between) a first conductive layer (e.g., the resonator element 115) and a second conductive layer (e.g., the ground plane). Such an electrical coupling of the communication feature occurs at a communication position on the structure of the device (e.g., resonator element). For illustration purposes and without limitation, example communication features may include vias, solder bumps, contact terminals, wires, and the like.

The example communication features 101, 102 illustrated by FIG. 1 are vias. The term "via" or "vias" as used herein may refer to one or more holes (and the corresponding components, such as pads, barrels, electric plating, etc.) that are drilled, cut, or otherwise formed in a resonator (i.e., through an insulating substrate) to permit an electrical connection to be formed between adjacent conductive layers. Because the conductive layers of a resonator may be electrically connected in a number of locations, a pattern of vias or as may be referred to herein, a pattern of communication features may be formed.

In many applications, the formation of a first conductive layer (e.g., the formation of resonator element 115 of FIG. 1 onto insulating substrate 100) may be part of a separate operation from the formation of one or more communication features (e.g., communication features 101, 102 of FIG. 1). Due to manufacturing tolerances or other errors, inconsistencies in the positioning of the communication feature(s) relative to the first conductive layer can occur. Such positioning inconsistencies can result in the communication feature(s) being offset from their intended (e.g., designed) positions.

Turning to FIG. 1, once the resonator element 115 is formed on the insulating substrate 100, the communication features 101, 102 (e.g., vias in the depicted embodiment) may be formed to electrically couple the resonator element 115 to the ground plane (not shown). For example, one common via forming technique includes simply drilling holes through the resonator element 115, the insulating substrate 100, and the ground plane (not shown) and the filling such holes with a conductive material. In some cases, the drilling operation may be misaligned relative to intended (e.g., designed) positions (e.g., represented in FIG. 1 by phantom communication feature positions 111, 112, respectively). As described herein and noted above, in some embodiments, this misalignment may be referred to as "registration error."

In some applications, registration error can be relatively consistent across a device (e.g., each communication feature may be offset from a desired communication position by about the same amount and in the same direction). In other applications, registration error may vary by communication feature.

Registration errors can have a significant impact on the operation of a radio frequency device because, for example, misalignment of the communication features can result in undesirable lengthening or shortening of the effective length of a resonator element (e.g., the length between one end of the resonator element and the communication position of the communication feature). As will be appreciated by one of ordinary skill in the art in view of the foregoing disclosure, this lengthening or shortening can change the radio frequency characteristics of a radio frequency circuit component, such as the resonator 120 of FIG. 1. Eliminating or reducing the impact of registration errors, and their corresponding radio frequency characteristic changes, by increasing the accuracy and precision of radio frequency circuit component fabrication processes can be expensive to implement particularly if the components are small in size.

As noted above, FIG. 1 illustrates an example registration error associated with resonator 120. In particular, positions for communication features 101, 102, referred to herein as "communication positions", are misaligned relative to intended (e.g., designed) communication positions 111, 112. This misalignment or registration error may change the effective length 108 of resonator element 115 and therefore change the radio frequency characteristics of the resonator 120. As will be appreciated by one of skill in the art, simply for illustration purposes, the effective length 108 is shown in FIG. 1 as defined between the first end 106 of resonator element 115 and the first communication feature 101. In other embodiments, an effective length for resonator element 115 may be defined between another part of communication feature 101 and the first end 106 or perhaps between a part of the second communication feature 102 and the first end 106.

Various example embodiments are directed to resonator structures that operate to minimize or reduce the impact of registration errors. Indeed in some embodiments, the design of a conductive layer (e.g., resonator element) may be modified to account for or reduce the effects of potential registration errors, notwithstanding the specific direction and/or magnitude of the registration error (e.g., misalignment, offset, etc.) being unknown at design time.

To compensate for the issues that can arise from the introduction of registration error, example embodiments may employ modified conductive layers that minimize or eliminate undesired radio frequency characteristic changes. According to some example embodiments, a conductive layer may define an error limiting feature that is configured to compensate for registration error by reducing the aggregate change in the effective length caused by registration errors. As will be discussed in greater detail below, error limiting features structured in accordance with various embodiments may be defined by the conductive layer between a communication position and a first end of the conductive layer.

Figure 2:
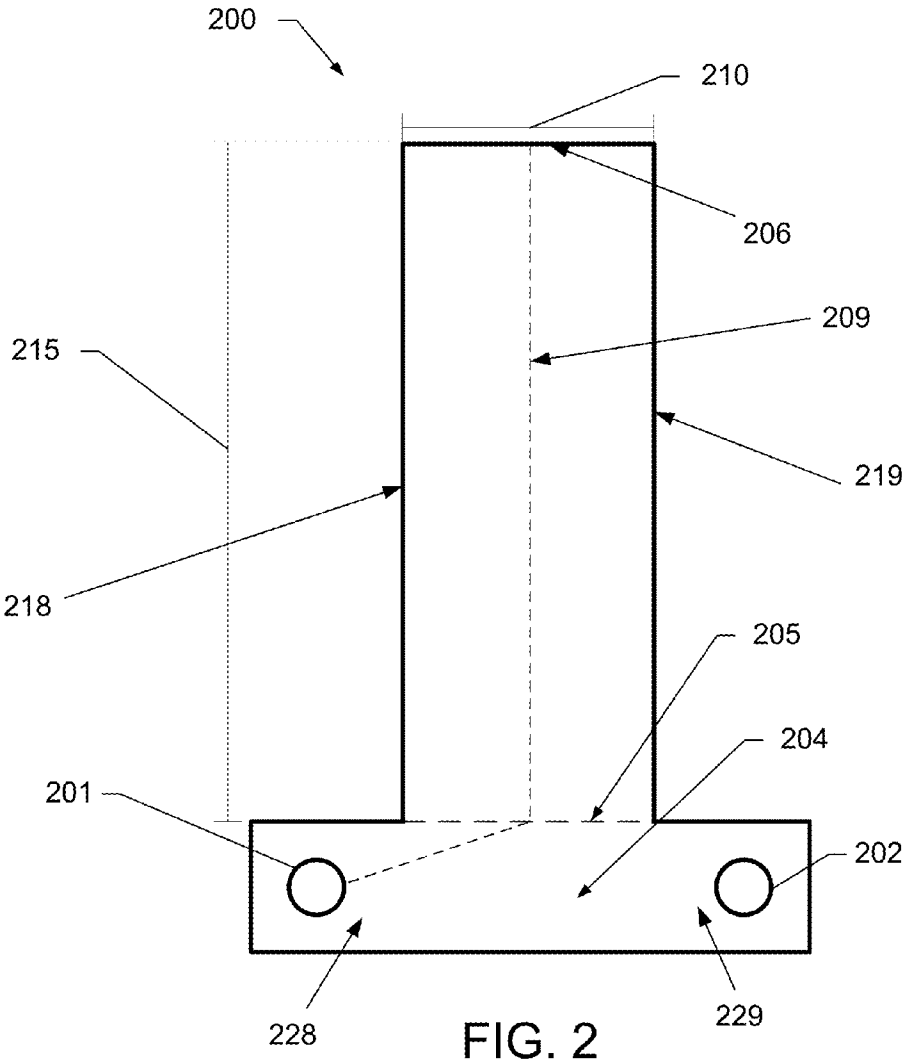
FIG. 2 illustrates an example resonator element according to various example embodiments.

FIG. 2 illustrates one example embodiment that includes a conductive layer (e.g., a resonator element 200) having an error limiting feature defined by extension portion 204. In the depicted embodiment, the resonator element 200 defines a first end 206 and an opposing second end 205. One of ordinary skill in the art would appreciate that the second end 205 is merely provided for reference within this description for purposes of describing relative physical positioning and not necessarily with respect to the resonant characteristics of the device. Additionally, the resonator element 200 defines a first lateral edge 218 and an opposing second lateral edge 219.

In the depicted embodiment, the extension portion 204 is positioned proximate the second end 205 and extends laterally from the first lateral edge 218 and the second lateral edge 219. A first communication feature 201 and a second communication feature 202 are positioned on the extension portion 204. More specifically, the first communication feature 201 is positioned on a first portion 228 of the extension portion 204 that extends laterally from the first lateral edge 218. Likewise, the second communication feature 202 is positioned on a second portion 229 of the extension portion 204 that extends laterally from the second lateral edge 219. In such a manner, the first and second communication features 201, 202 are positioned outside the footprint of the resonator element 200 (e.g., as defined by the resonator width 210). Additionally the extension portion 204 is positioned between the communication positions (and corresponding communication features 201, 202) and the first end 206 of the resonator element 200.

The resonant element 200 also defines a resonant element width 210 and a resonant element length 215. As noted above, the effective length 209 of the resonator may not be the same as that of the resonant element length 215 due to the contribution of the extension portion 204 to the resonant characteristics of the resonator element 200. Indeed, for illustration purposes, as shown in the depicted embodiment, the foregoing description approximates an effective length 209 for the resonator element 200 as the sum of the resonant length 215 and imaginary paths defined between the resonator element end 205 and each respective communication position of a corresponding communication feature 201, 202.

With reference to FIG. 2, the extension portion 204 (e.g., the error limiting feature) is positioned between the communication positions and corresponding communication features 201, 202 and the first end 206 of the resonator element 200. By positioning the communication positions of each corresponding communication features 201, 202 on the extension portion 204 (e.g., the error limiting feature) and thereby changing the geometry of the effective length 209, as described in greater detail below, registration errors have a reduced effect on the radio frequency characteristics of the resonator element 200.

Figure 2A:
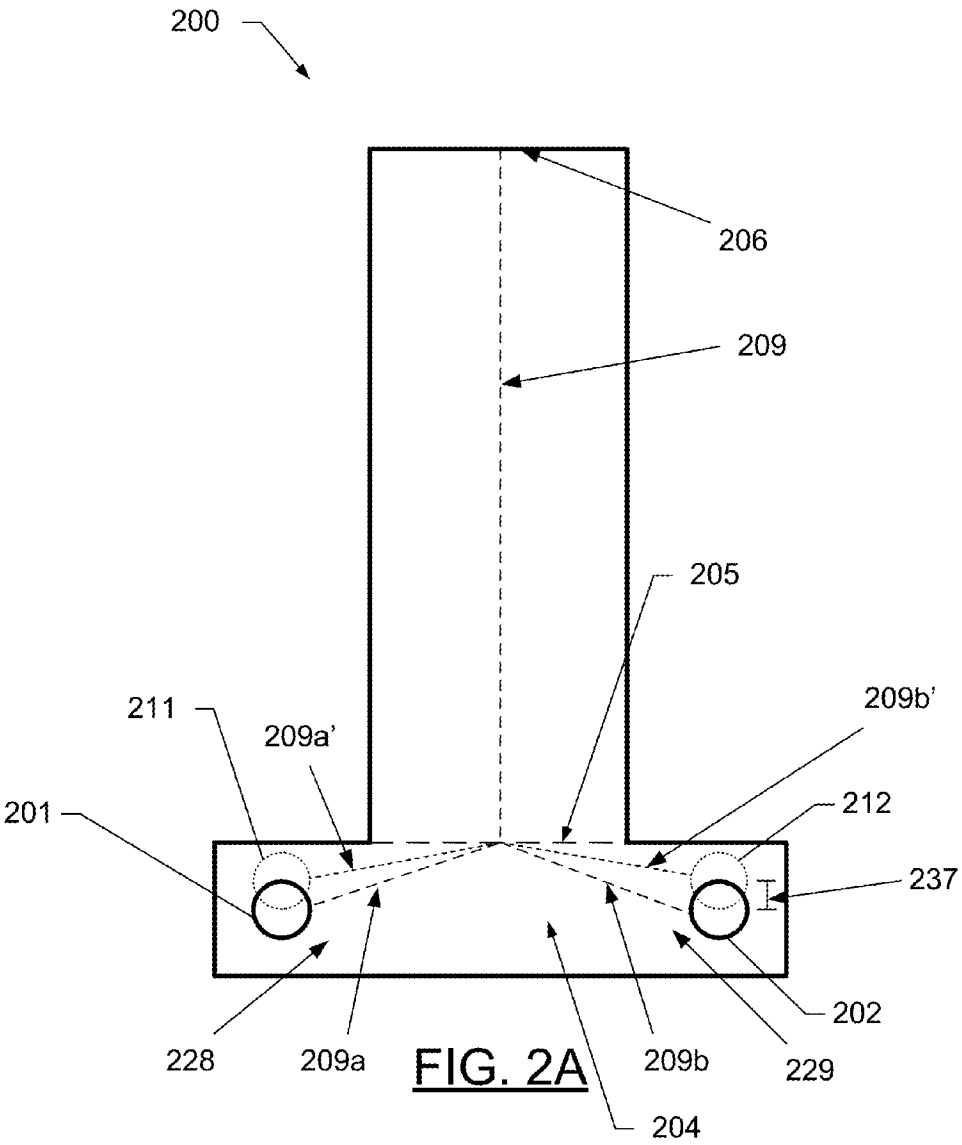
FIG. 2A illustrates an example occurrence of registration error in the longitudinal direction on the resonator element shown in FIG. 2 according to various example embodiments.

For example, FIG. 2A illustrates that use of the error limiting feature of an extension portion may reduce the effect of registration errors in the longitudinal direction (e.g., the direction defined by a path between the first end 206 and the second end 205). In particular, misplacement of the communication position (and communication features) in the longitudinal direction will have a reduced effect on the frequency characteristics of the resonator element 200 because misplacement of the communication position (and communication features) in the longitudinal direction will have a reduced effect on the effective length 209 of the resonator element 200 (e.g., distance from the second end 205 of the resonator element 200 to each communication feature 201, 202) due to the geometry. As shown in FIG. 2A, to maintain the desired frequency characteristics of the resonator element 200, the communication positions of the communication features are intended (e.g., designed) at 201, 202. However, as noted above, registration error may occur such that the communication features 211, 212 may actually be misplaced on the resonator element 200 (e.g., communication features 211, 212 are positioned a distance 237 away from the intended position of the communication features 201, 202 in the longitudinal direction). However, due to the communication position placement on the extension portion, the resultant change in the effective length due to the misplacement in the longitudinal direction (e.g., registration error) may be less than if the communication positions were not on an extension portion, such as the resonator element 115 shown in FIG. 1. Indeed, though the communication features 211, 212 are misplaced from the communication features 201, 202 by a distance 237, the effective lengths 209*a*', 209*b*' are much closer to the intended effective lengths 209*a*, 209*b*. In such a manner, misplacement of communication features positioned on an extension portion may cause less of a change in the effective length of the resonator element, thereby reducing the effects on radio frequency characteristics of the resonator element.

Though the above example may only provide a reduction of the effects of registration error and/or misalignment in the longitudinal direction, such a concept for a reduction of the effects of registration error and/or misalignment in the longitudinal direction can be easily translated to the lateral direction in view of this disclosure. For example, as noted above, misplacement of the communication position (and communication features) in the lateral direction will likely be equivalent for each communication feature. Thus, positioning of two communication positions (and two corresponding communication features) such that they are on opposite sides of the central longitudinal axis of the resonator element will reduce the effects of misplacement in the lateral direction. Additionally, positioning of two communication positions (and two corresponding communication features) such that they are symmetrical in the lateral direction (e.g., such as between a central longitudinal axis of the resonator element 200 shown in FIG. 2B) will reduce the effects of misplacement in the lateral direction.

Figure 2B:
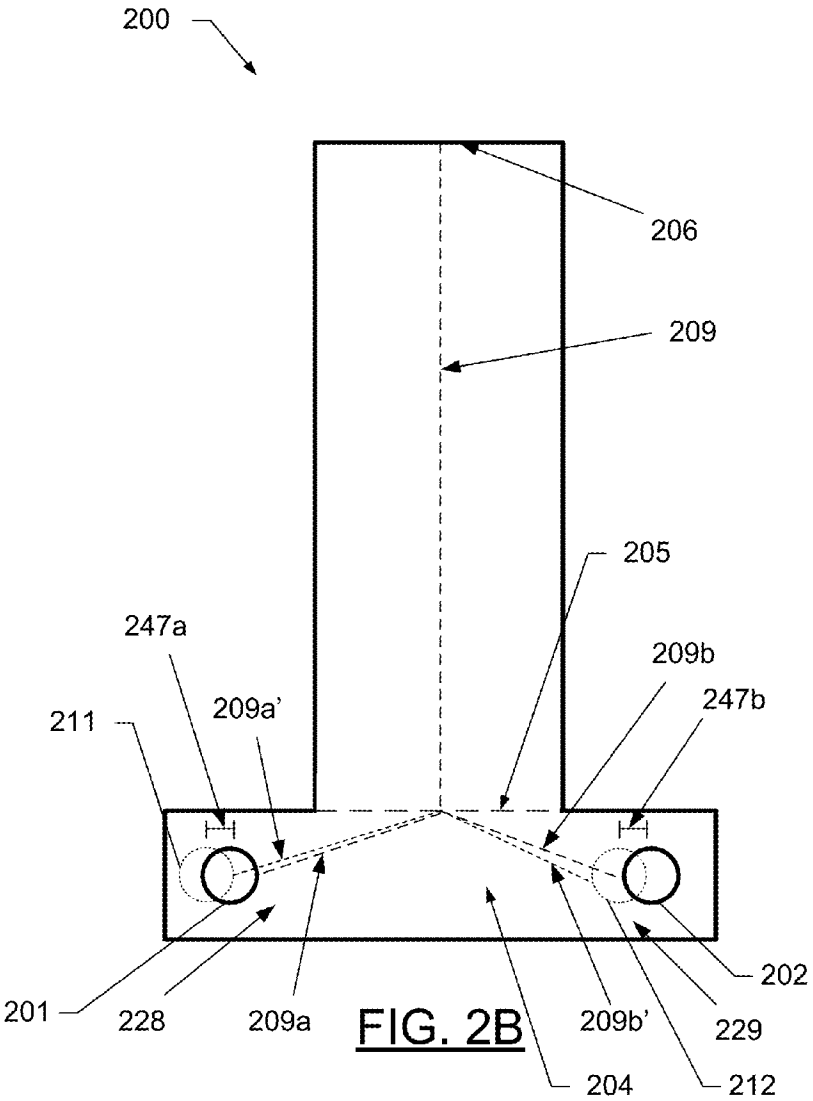
FIG. 2B illustrates an example occurrence of registration error in the lateral direction on the resonator element shown in FIG. 2 according to various example embodiments.

For example, as shown in FIG. 2B, to maintain the desired frequency characteristics of the resonator element 200, the communication positions of the communication features are intended (e.g., designed) at 201, 202. However, as noted above, registration error may occur such that the communication features 211, 212 may actually be misplaced on the resonator element 200 (e.g., communication features 211, 212 are positioned a distance 247*a*, 247*b* , respectively, away from the intended position of the communication features 201, 202 in the lateral direction). However, due to the symmetry between the communication positions and the consistency of the registration error, the resultant change in the effective length due to the misplacement in the lateral direction (e.g., registration error) may be less than if the communication positions were not symmetrical. Indeed, though the communication features 211, 212 are misplaced from the communication features 201, 202, the increase in the effective length 209*a*' to communication feature 211 is offset by the decrease in the effective length 209*b*' to communication feature 212. In such a manner, misplacement of communication features symmetrically positioned on an extension portion may cause less of a change in the effective length of the resonator element, thereby reducing the effects on radio frequency characteristics of the resonator element.

Figure 2C:
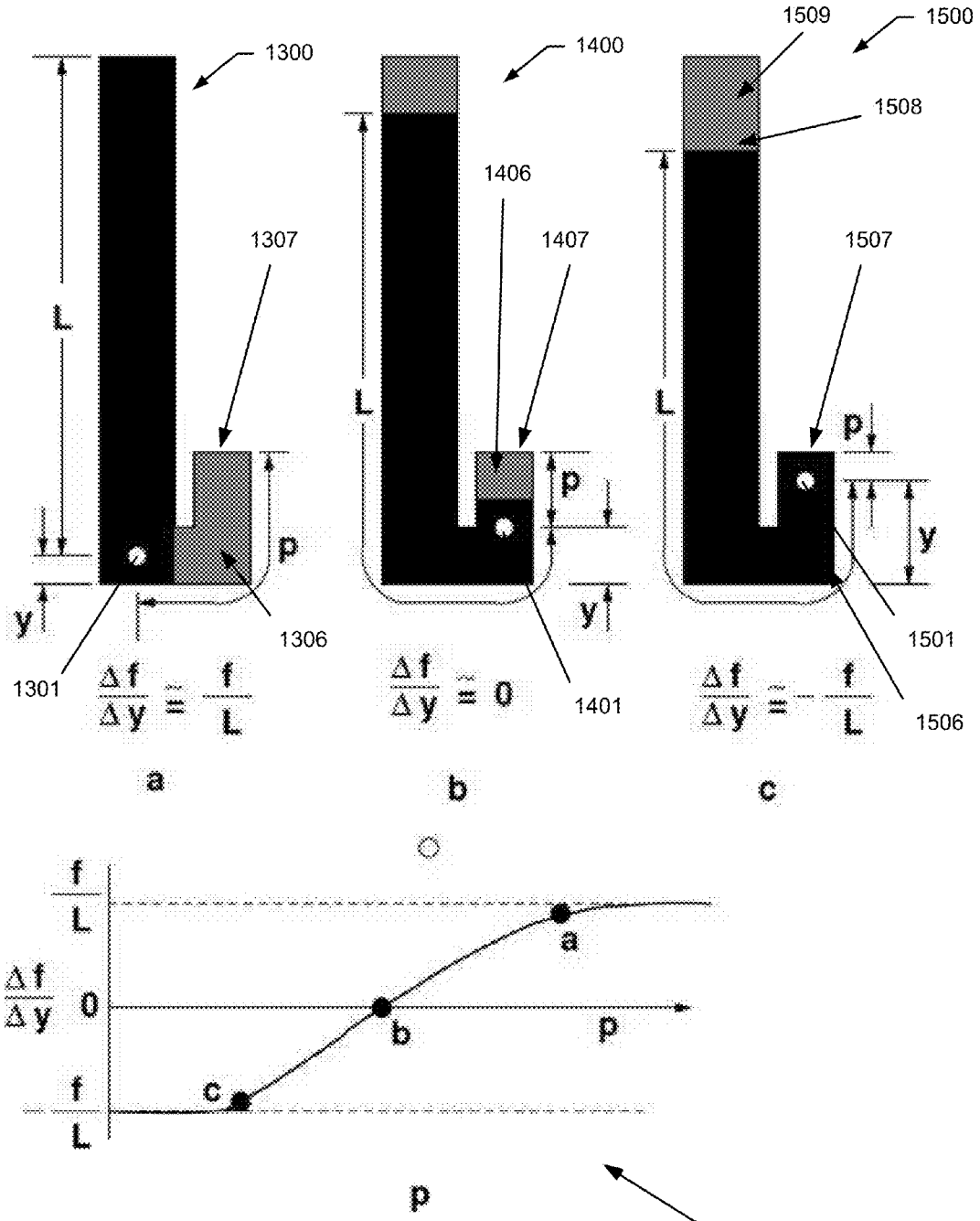
FIG. 2C shows three different resonator elements in accordance with an example embodiment and a corresponding chart illustrating a general theoretical relationship identified in connection with various example embodiments.

FIG. 2C illustrates further theory involved at reduction of the effects of registration error in the longitudinal direction on radio frequency characteristics. In particular, FIG. 2C shows resonator elements 1300, 1400, and 1500. Resonator elements 1400 and 1500 define error limiting features, i.e., extension portions 1406 and 1506, while resonator 1300 does not. The depicted resonators 1300, 1400, and 1500 are provided to better illustrate the effects of one exemplary error limiting feature on the effects of registration error in the longitudinal direction.

As shown in FIG. 2C, the different grey sections of resonator elements 1300, 1400, 1500 are presented in order to illustrate the changes to the footprint of each resonator element with respect to each other. These changes are needed in order to theoretically produce a similar frequency between resonator elements 1300, 1400, 1500. For example, resonator element 1300 does not actually define an extension portion and, thus, the extension portion 1306 is grey. Along these lines, the resonator element 1500 defines an extension portion 1506, but has less material near the first end 1508 so as to product a similar frequency. As such the top portion 1509 is grey.

The first resonator element 1300 has a communication feature 1301 within the normal footprint of the resonator element 1300, such as shown in the resonator element 115 shown in FIG. 1. The third resonator element 1500 has a communication feature 1501 positioned near the upper edge 1507 of the extension portion 1506. The second resonator element 1400 has a communication feature 1401 positioned on the extension portion 1406 between the position of the communication feature 1301 of the first resonator element 1300 and the position of the communication feature 1501 of the third resonator element 1500.

With reference to the chart 1600 of FIG. 2C, the communication position of the communication feature of each resonator element with respect to the extension portion (if there is one) may help reduce the effect of the change in frequency (Δf) from any observed change in the longitudinal direction (Δy) such as from registration error. With the above in mind, the goal may be to reduce the change in frequency (Δf) due to the change in longitudinal direction (Δy) to 0.

It has been observed that the communication position of the communication feature 1301 in the first resonator element 1300 creates a linear relationship of the change in frequency (Δf) due to a change in longitudinal direction (Δy) over the length (L) of the resonator element 1300 (e.g., (Δf)/f~=(Δy)/L). This relationship means that any change in the longitudinal direction (Δy) may result in a positive change in frequency (Δf), since f and L are constant. Such an example as illustrated with the first resonator element 1300 is labeled "a" in the chart 1600.

It has also been observed that the communication position of the communication feature 1501 in the third resonator element 1500 creates a negative linear relationship of the change in frequency (Δf) due to a change in longitudinal direction (Δy) over the length (L) of the third resonator element 1500 (e.g., (Δf)/f~=−(Δy)/L). This relationship means that any change in the longitudinal direction (Δy) may result in a negative change in frequency (Δf), since f and L are constant. Such an example as illustrated with the third resonator element 1500 is labeled "c" in the chart 1600.

As shown in FIG. 2C, the first resonator element 1300 has the largest distance (p) between the communication feature 1301 and the upper edge 1307 of the "imaginary" extension portion 1306. In opposite, the third resonator element 1500 has the smallest distance (p) between the communication feature 1501 and the upper edge 1507 of the extension portion 1506. Thus, the relationship between change in frequency (Δf) due to a change in longitudinal position (Δy) shown at "a" from the first resonator element 1300 and "c" from the third resonator element 1500 may be plotted on the chart 1600 as shown. When doing so, there is shown a relationship between "a" and "c" that indicates that there must be a point on the chart 1600 in which the relationship of the change frequency (Δf) over the change in longitudinal direction (Δy) goes to 0. Such a point may be indicated as "b" and illustrated with the example of the second resonator element 1400. In the second resonator element 1400, the communication position of the communication feature 1401 between that of the first resonator element 1300 and the third resonator element 1500 reduces the effects that any change in longitudinal direction (Δy) would have on the change in frequency (Δf), since such positioning will move the ratio of (ΔPI(Δy) closer to 0. As such, by positioning the communication position of the communication feature on an extension portion similar to that shown in resonator element 1400, any changes in the longitudinal direction due to registration error may have reduced effects on the radio frequency characteristics of the resonator.

Figure 2D:
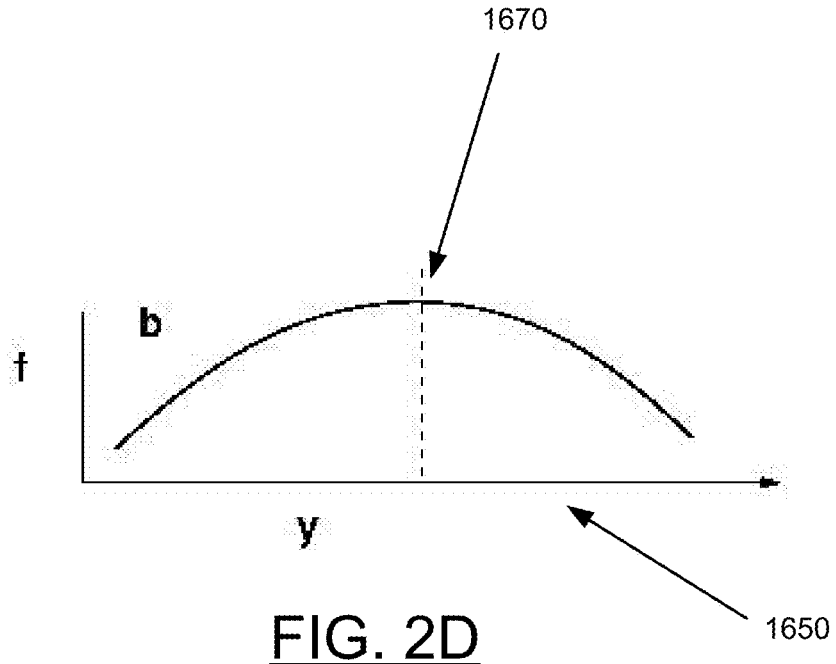
FIG. 2D shows a chart illustrating the resonant frequency compared to the position of the communication feature on an example resonator provided in FIG. 2C.

Equivalently, the communication position indicated in FIG. 2C at "b" may place the communication feature nominally at a point of an extremum of frequency for resonator element 1400. Due to geometric considerations, increasing dimension y so as to move the communication position upwards relative to resonator element 1400 causes an increase in effective length of resonator element 1400 and, hence, a decrease in resonant frequency. Likewise, decreasing dimension y so as to move the communication feature downward also increases the effective length of resonator element 1400, thus also decreasing resonant frequency. For example, with reference to Chart 1650 shown in FIG. 2D, the nominal communication position of communication feature 1401 at the point shown (represented at line 1670 in Chart 1650) is such that the resonant frequency of resonator element 1400 is at its maximum and, hence may be relatively insensitive to misplacement of the communication position (and communication feature 1401) in the longitudinal direction (e.g., dimension y shown on the horizontal axis of Chart 1650).

FIGS. 3-6 illustrate resonator elements that compensate for registration error due to their architecture. The resonator elements may be formed, for example, of a metallic material or layer that is bonded to a substrate and etched, applied to a substrate after being formed, or the like. The depicted resonator elements may, in some cases, be part of a filter or a collection of parts that define a filter (e.g., shown in FIGS. 7-8 and 10). In the example embodiments shown in FIGS. 3-8 and 10, the resonator elements define an error limiting feature that comprises an extension portion. As further described below, in some embodiments, one or more communication positions and corresponding communication features may be placed on the extension portion. In such a manner, as will be described in greater detail herein, the effective length of the resonator element may be changed to reduce the effects of registration error.

Figure 3:
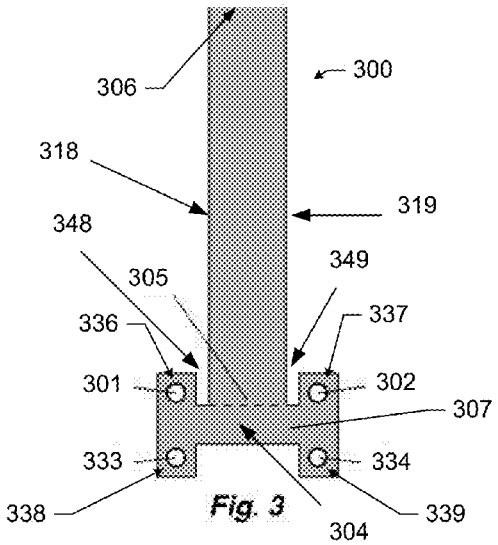
FIGS. 3-6 illustrate example resonator elements according to various example embodiments.

FIG. 3 illustrates another example embodiment that includes a metallization layer structure (e.g., resonator element 300) with an error limiting feature (e.g., extension portion 304). In the depicted embodiment, the extension portion 304 is positioned proximate the second end 305 and extends laterally from the first lateral edge 318 and the second lateral edge 319. Additionally, the extension portion further defines at least one tab that extends longitudinally in at least one direction from an edge of the extension portion. In the depicted embodiment, the extension portion defines four tabs 336, 337, 338, 339 that each extend longitudinally from an edge of the extension portion 304. The tabs 336, 337, 338, 339 cause the extension portion 304 to define an H-shape. In such a regard, gaps 348 and 349 may be defined adjacent to the first and second lateral edges 218, 219, respectively. Such gaps 348 and 349 may operate to displace at least the upper two tabs 336, 337 from the resonator element 300.

In some embodiments, at least one communication feature may be positioned at least partially on at least one tab of the extension portion. For example, in the depicted embodiment of FIG. 3, four communication features 301, 302, 333, 334 are positioned on each tab 336, 337, 338, 339, respectively. In such a regard, similar to the embodiment depicted in FIG. 2B consistent registration error among the four communication features 301, 302, 333, 334 will produce increased effective lengths to some, simultaneously offset by decreased effective lengths to the others, thus reducing the effects of registration error. This offsetting effect can take place in both the longitudinal and lateral directions. Moreover, gaps 348 and 349 serve to further reduce the effects of registration error for longitudinal displacement of communication features 301 and 302 according to the effect described in relation to FIG. 2C.

Figure 4:
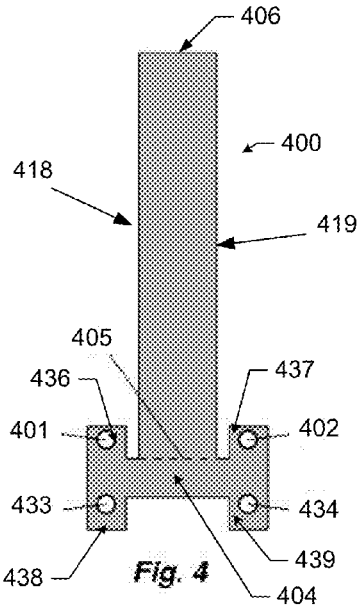
Figure 5:
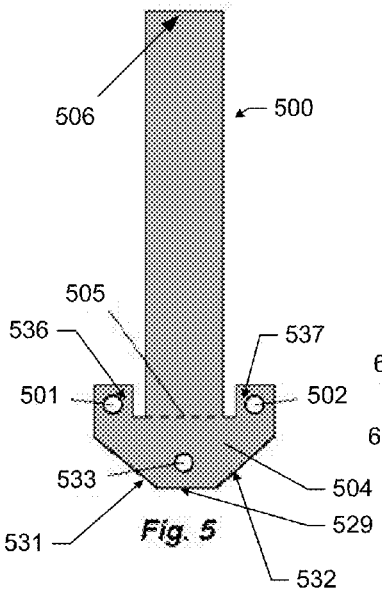
Figure 6:
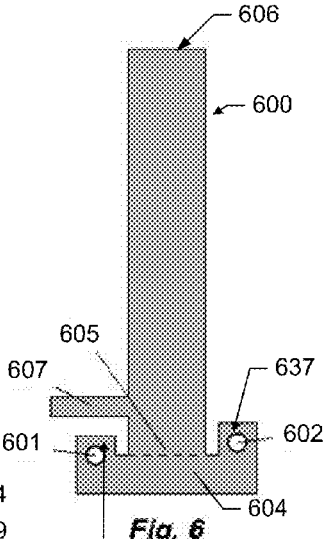

FIGS. 4-6 illustrate additional embodiments of metallization layer structures with variations in error limiting features. The variations illustrate just some example ways to define the error limiting feature (e.g., extension portion) to reduce the effects of registration error. Additionally, as noted above, the positioning of at least one communication feature may also reduce the effects of registration error.

For example, FIG. 4 illustrates an example metallization layer structure (e.g., resonator element 400) with a similar extension portion 404 as that shown in FIG. 3. However, the communication features 401, 402, 433, 434 have been displaced longitudinally from their intended communication positions (e.g., the communication positions corresponding to communication features 301, 302, 333, 334 of the resonator element 300 of FIG. 3). For example, communication features 401, 402 are positioned proximate the upper edge of the tabs 436, 437, respectively. Moreover, communication features 433, 434 are positioned only partially on tabs 438 and 439. Though the communication features 401, 402, 433, 434 have been misplaced in the longitudinal direction (e.g., a registration error has occurred), the effect of the registration error in the longitudinal direction is reduced due to the geometry and symmetry created by the positioning of the communication features on the extension portion 404. Indeed, though the misplacement of each communication feature has occurred upwardly with respect to the resonator element 400, little effect has occurred to the average effective lengths between the first end 406 and each communication feature 401, 402, 433, 434. For example, due to geometry the amount of upward change of communication feature 401 (as opposed to communication feature 301 of resonator element 300) has had a reduced effect on the effective length between first end 406 and the communication feature 401. Moreover, due to the longitudinal symmetry of communication features 401 and 433, any increase in effective length between the first end 406 and the communication feature 401 is offset by the decrease in effective length between the first end 406 and the communication feature 433. As such, due to both the symmetry and the geometry of the positioning of the communication positions (and corresponding communication features) on the extension portion 404, the registration error illustrated in FIG. 4 has a reduced effect on changes in the radio frequency characteristics of the resonator element 400.

Example embodiments of FIGS. 5-6 also illustrate variations in positioning of the communication positions of the respective communication features. FIGS. 5-6 provide only some contemplated example variations of design of a metallization layer structure with an error limiting feature configured to reduce changes in radio frequency characteristics of the resonator element due to registration error and, thus, example embodiments of the present invention contemplate many other variations.

FIG. 5 illustrates another example metallization layer structure (e.g., resonator element 500) with an extension portion 504 that defines a heart-like or anchor-like shape. The extension portion 504 defines two tabs 536, 537 that extend longitudinally toward the first end 506. Additionally, the extension portion 504 defines two sloped surfaces 531, 532. In the depicted embodiment, the resonator element 500 defines only three communication features 501, 502, 533.

In a similar manner to the resonator element 300 in FIG. 3, communication features 501, 502 are positioned on the tabs 536, 537, respectively. Additionally, however, communication feature 533 is positioned in roughly the center of the extension portion 540 proximate a bottom edge 529. By positioning the communication positions of the communication features as depicted in FIG. 5, the resonator element 500 may reduce the effect of registration errors due to the geometry. Indeed, imaginary paths (not shown) may be defined from the second end 505 to each of the communication features 501, 502, 533 to approximate the path of electrical energy when establishing a ground connection. As can be seen in FIG. 5 (relative to FIG. 3) the imaginary path distances create different effective lengths yet with some offsetting tendencies that can reduce the effects of registration error.

FIG. 6 illustrates another example embodiment that includes a metallization layer structure (e.g., resonator element 600) that may be part of a filter (not shown). As such, the resonator element 600 may define a port 607 for the filter. The resonator element 600 defines an extension portion 604. Similar to FIG. 3, the extension portion 604 may be shaped as an upper half of an H-shape. In this regard, two communication features 601, 602 may be positioned on respective upper tabs 636, 637 of the extension portion 604. However, the tabs 636, 637 may not define the same length (i.e., extend longitudinally the same distance) and therefore an asymmetry may be present. In the depicted embodiment, tab 636 (e.g., the port side tab) extends in a longitudinal direction (e.g., toward the first end 606 of the resonator element 600) to a lesser degree than tab 637 (e.g., the non-port side tab). With the difference in length between tab 636 and tab 637, the respective communication features 601, 602 may be positioned asymmetrically with respect to each other.

In such a regard, the dimensions of the extension portion and the communication positions of the communication features can, according to some example embodiments, allow for a high degree of reduction in the sensitivity to registration error. In particular, while not intending to be limited by theory, sensitivity to registration error may correlate at least generally to relative changes in resonant length. Thus, positioning the communication features, such as shown in FIGS. 2 and 3-6, can operate to reduce the resultant change in resonant length and also the impedance to ground as well as from any circuitry which may be coupled to the resonator element.

Figure 7:
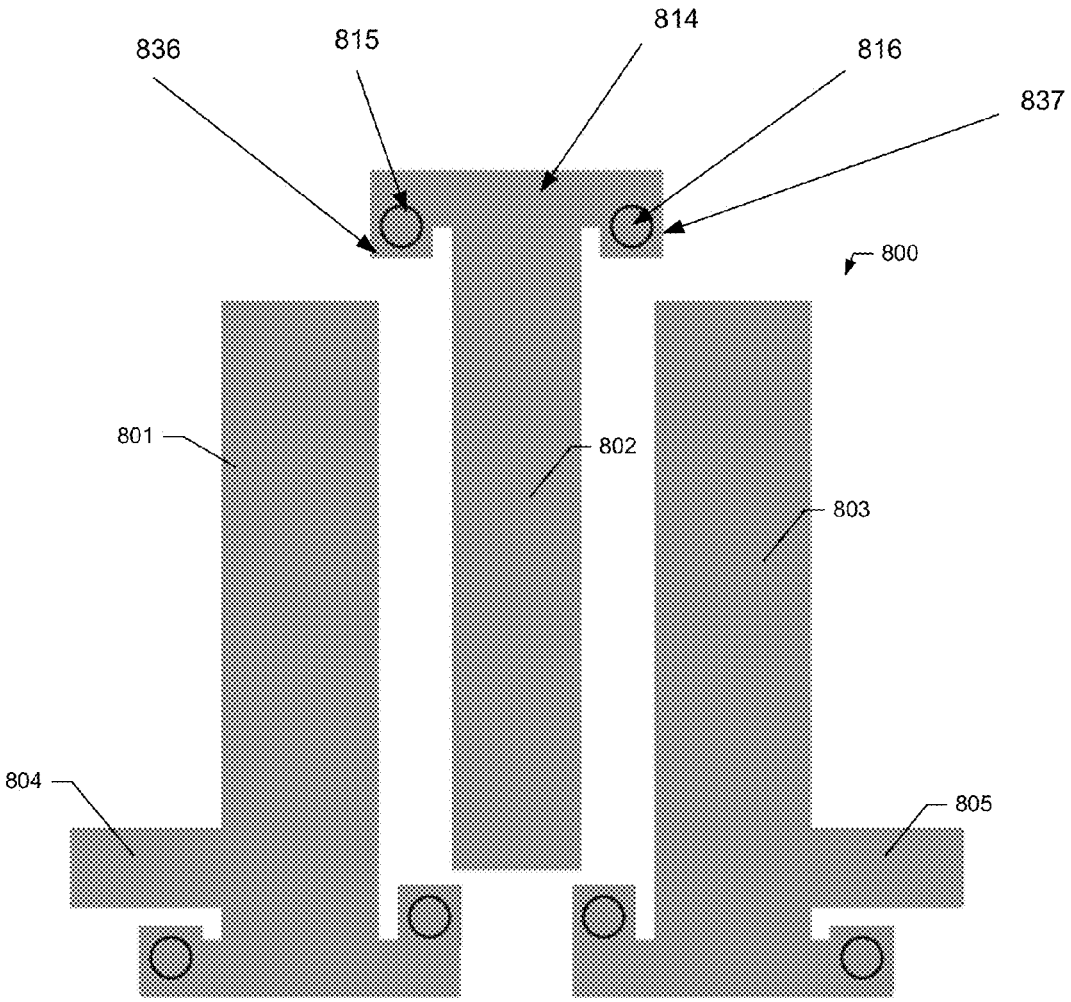
FIG. 7 illustrates an example filter according to various example embodiments.
Figure 8:
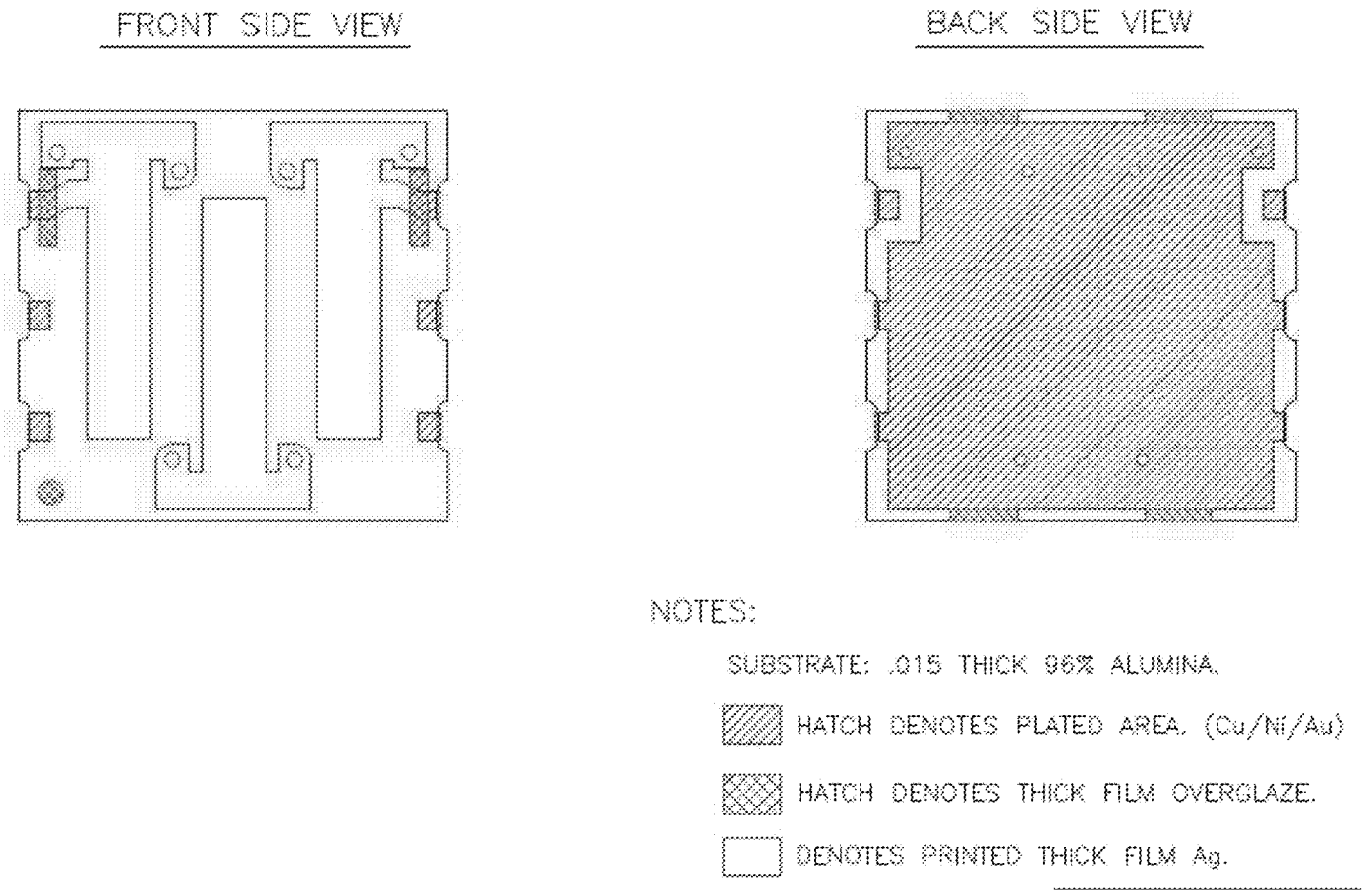
FIG. 8 illustrates a layout of a filter and a ground plane according to various example embodiments.
Figure 10:
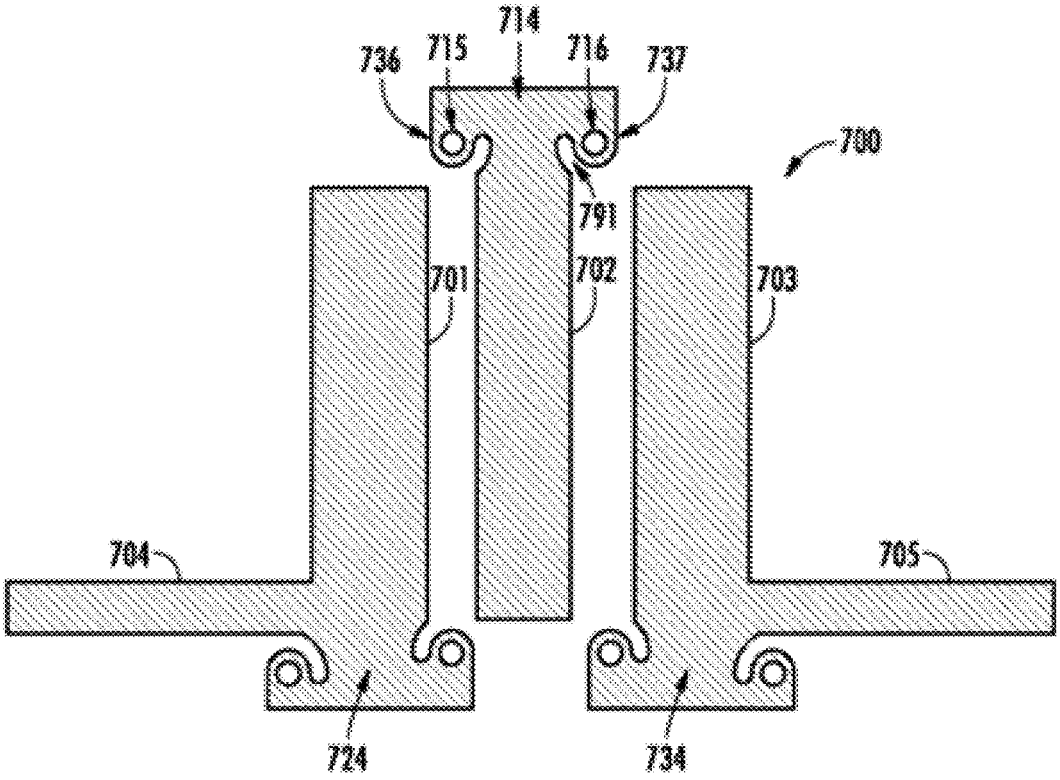
FIG. 10 illustrates another example filter according to various example embodiments.

FIGS. 7-8 and 10 illustrate example embodiments in the form of a collection of metallization layer structures to form an interdigital filter. The following description outlines techniques and embodiments in the context of filter design, however, one of ordinary skill in the art would appreciate that the techniques and embodiments described herein can be applied to other resonator design contexts.

FIG. 7 depicts a filter 800 that includes a number of metallization layer structures (e.g., resonator elements 801, 802, and 803). In the depicted embodiment, resonator element 801 has a similar architecture to resonator element 600 (shown in FIG. 6), and similarly includes a port 804. Along these same lines, resonator element 803 may be an inversion of the resonator element 801 with a port 805. Additionally, resonator element 802 may have a half H-shape extension portion 814 where each of the two tabs 836, 837 may define the same length, and the communication features 815, 816 may be placed within tabs 836, 837, respectively.

FIG. 8 illustrates an example layout for a filter design according to various example embodiments. In the context of FIG. 8, the front side view illustrates the design of the first conductive layer (e.g., resonator elements forming a filter), while the back side view illustrates the second conductive layer (e.g., the corresponding ground plane).

Figure 9:
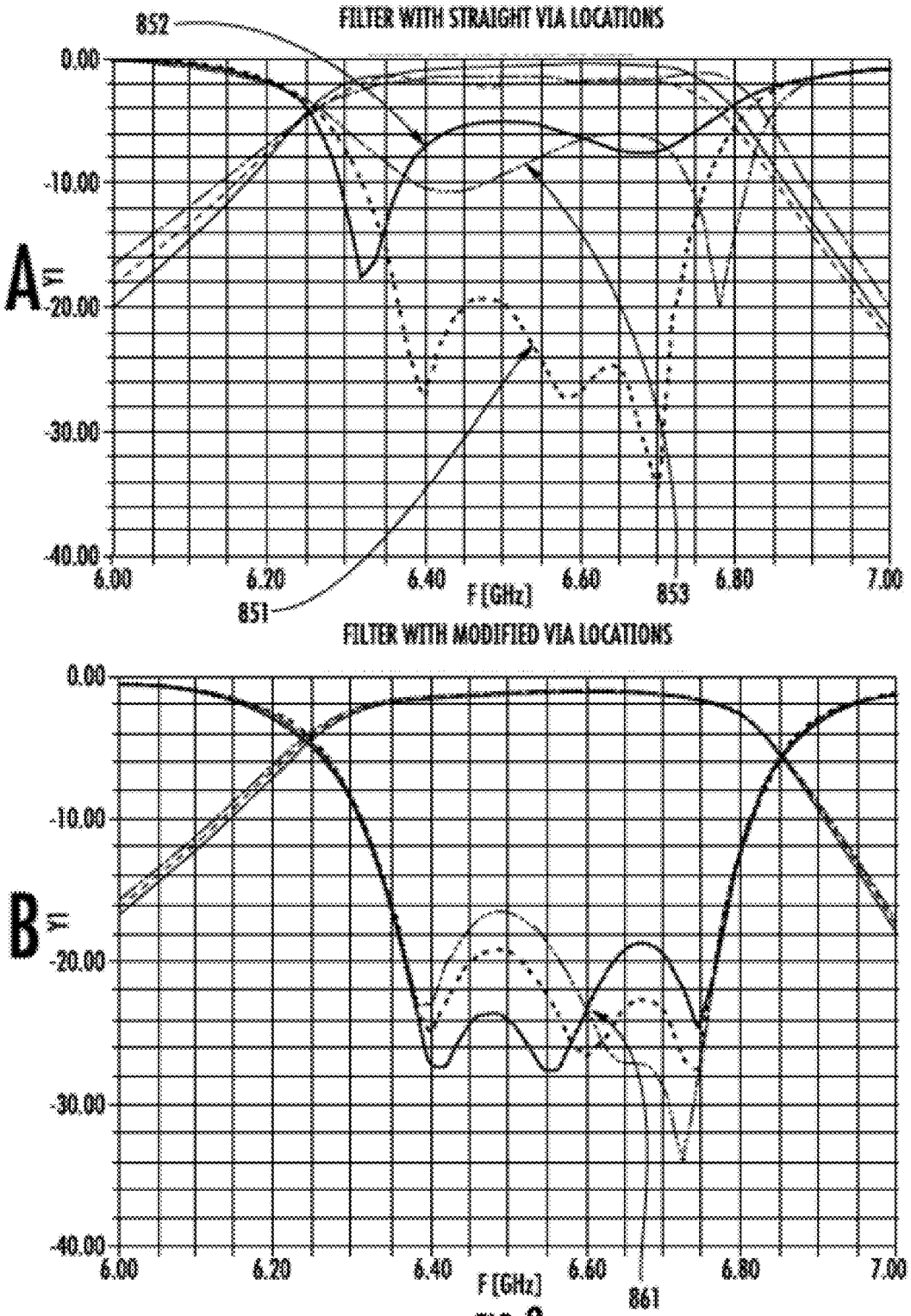
FIG. 9 illustrates a response comparison involving the operation of an example filter according to various example embodiments relative to a conventional filter.

FIG. 9 provides graphs A and B that compare the response of a conventional interdigital filter, made from elements as depicted in FIG. 1, at 6.55 GHz with a bandwidth of about 500 MHz (Graph A), with one using the structure of an example embodiment, such as a filter with resonator elements including an error limiting feature, of the types shown in FIG. 7 and FIG. 8 (Graph B) in the presence of a 2-mil registration error in an up and a down (i.e., longitudinal) direction. In particular, Graphs A and B show input return loss ("S11") and insertion loss ("S21") of each of the three conventional filters and each of the three filters with an error limiting feature. As indicated in the graphs, the variations in Graph A are greatly reduced with the example embodiment structure as provided in Graph B.

For example, with reference to Graph A, the conventional filter may have a response 851 for a filter with no registration error (e.g., the communication position was properly placed in the designed position). However, as shown in Graph A, a slight registration error of −2 mils creates a response 852 that is different than the intended response 851. Similarly, a slight registration error of +2 mils creates a response 853 that is different than the intended response 851. In contrast, with reference to Graph B, a slight registration error in either direction (e.g., either −2 mils or +2 mils) presents less variation in the response (e.g., shown near 861).

Filters can often require a high level of precision in both the metallization layer (e.g., the metal layer that includes radio frequency tuned elements) and in the relative communication position of the corresponding communication features to the metallization. In both printed circuit boards and thick film processes, the precision of the metallization on a metallization layer, in terms of feature dimensions, may be very good, often better than +/−1 mil for all features. Furthermore, the relative placement of communication features may be similarly precise. The material of the substrate (e.g., plastic, ceramic, GaAs, or other types of substrate) may also be a factor in the degree of potential registration error. However, the registration of the metallization layer to the position of the communication features can often be a significant source of error and is typically as much as +/−3 mils for printed circuit board processes. Because the structures of the metallization layer are formed from different, independent steps, relative to the creation of the communication position and the corresponding communication features, an operationally significant lack of precision may be introduced. As a result, the communication position of the communication features may be systematically shifted in a given direction (e.g., right, left, up, or down) with respect to the structures of the metallization layer. At higher frequencies, for example above 6 GHz, overall feature sizes are sufficiently small for this systematic registration error to greatly degrade circuit performance by causing de-tuning of the resonant structures.

Some filters, for example, interdigital filters, may include a metallization structure that has particular resonant lengths and includes communication features at, for example, one end of the structure. The misalignment of the communication position can result in an undesirable change in the resonant length of the filter and can negatively impact the operation of the filter. For example, a 6.55 GHz filter on an alumina substrate that is subjected to 2 mils of registration error can cause a resonance shift of 80 MHz, which can significantly and negatively impact the response of the filter.

FIG. 10 illustrates another example embodiment of a filter. As depicted in FIG. 10, filter 700 may include a number of metallization layer structures (e.g., resonator elements 701, 702, and 703). In the depicted embodiment, resonator element 701 has a similar architecture to resonator element 600 (shown in FIG. 6), and similarly includes a port 704. Along these same lines, resonator element 703 may be an inversion of the resonator element 701 with a port 705. Additionally, resonator element 702 may define a half H-shape extension portion 714 where each of the two tabs 736, 737 may define the same length, and the communication features 715, 716 may be placed within the tabs 736, 737, respectively of extension portion 714. Moreover, in the depicted embodiments, the extension portions 724, 714, 734 are each defined such that a radiused transition (e.g., 791) exists between the extension portion and the first lateral edge of each resonator element. Such a radiused transition may provide for more repeatable creation (e.g., formation) of each resonator element. For many manufacturing processes, having sharp internal corners (e.g., shown in FIGS. 3-7) for the extension portion makes consistent formation of the resonator elements difficult and makes the resonator element more prone to variability. For example, chemical etching is well known to be less effective in a sharp internal corner, and can lead to incomplete and inconsistent removal for such features with sharp internal corners. Conversely, sharp external edges will have a tendency to become overetched and, hence, rounded. Having deliberately rounded edges, however, reduces the risk of incomplete or inconsistent etching and leads to a more consistent patterning.

Figure 11:
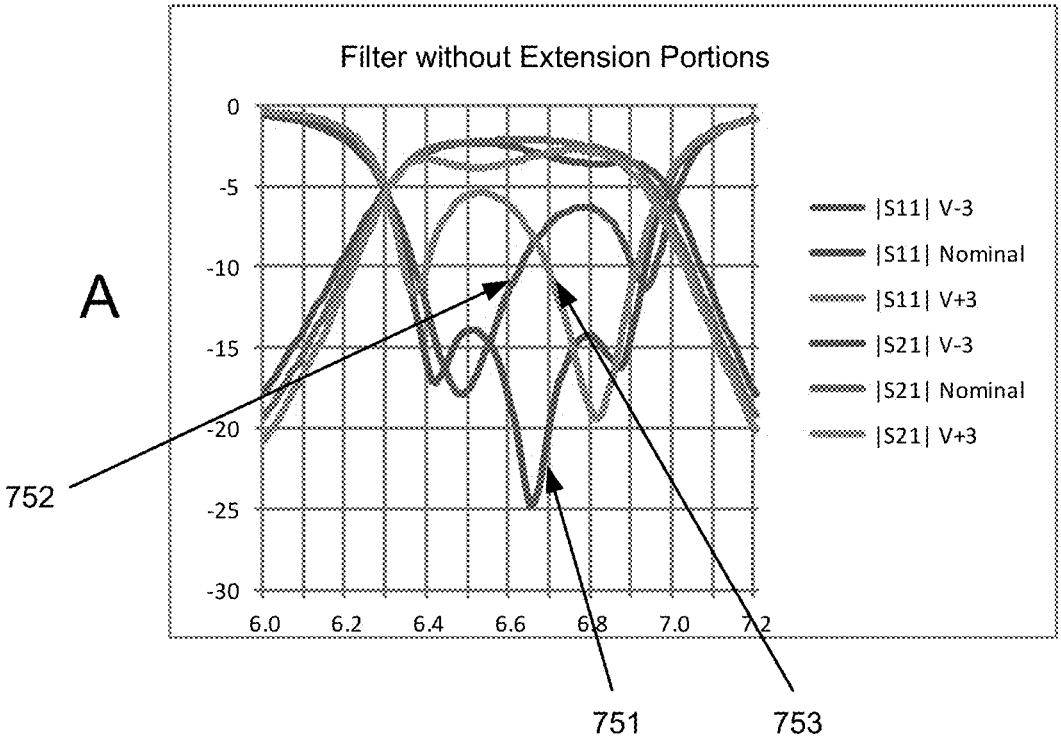
FIG. 11 illustrates a response comparison involving operation of the filter in FIG. 10 relative to a conventional filter.
Figure 11:
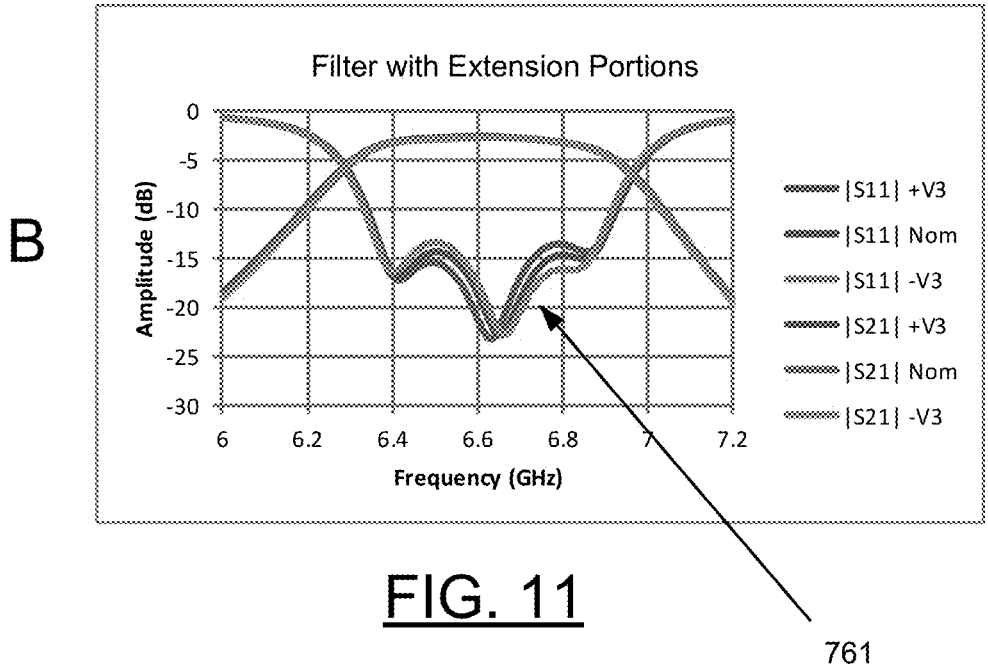

FIG. 11 provides graphs A and B that compare the response of a conventional interdigital filter at 6.55 GHz with a bandwidth of about 500 MHz (Graph A), with one using a design similar to example filter 700 illustrated in FIG. 10 which includes an error limiting feature of an extension portion (Graph B). Results of simulations using Ansoft HFSS of three conventional filters and three filters with the error limiting feature have been shown. One conventional filter and one filter with the error limiting feature has no registration error and other two conventional filters and filters with error limiting features include registration errors of 3 mils in the + and − longitudinal direction. In particular, Graphs A and B show input return loss ("S11") and insertion loss ("S21") of each of the three conventional filters and each of the three filters with an error limiting feature. As indicated in the graphs, the variations in Graph A are greatly reduced with the example embodiment structure as provided in Graph B.

For example, with reference to Graph A, the conventional filter may have a response 751 for a filter with no registration error (e.g., the communication position was properly placed in the designed position). However, as shown in Graph A, a slight registration error of −3 mils creates a response 752 that is different than the intended response 751. Similarly, a slight registration error of +3 mils creates a response 753 that is different than the intended response 751. In contrast, with reference to Graph B, a slight registration error in either direction (e.g., either −3 mils or +3 mils) presents less variation in the response (e.g., shown near 761).

Figure 11A:
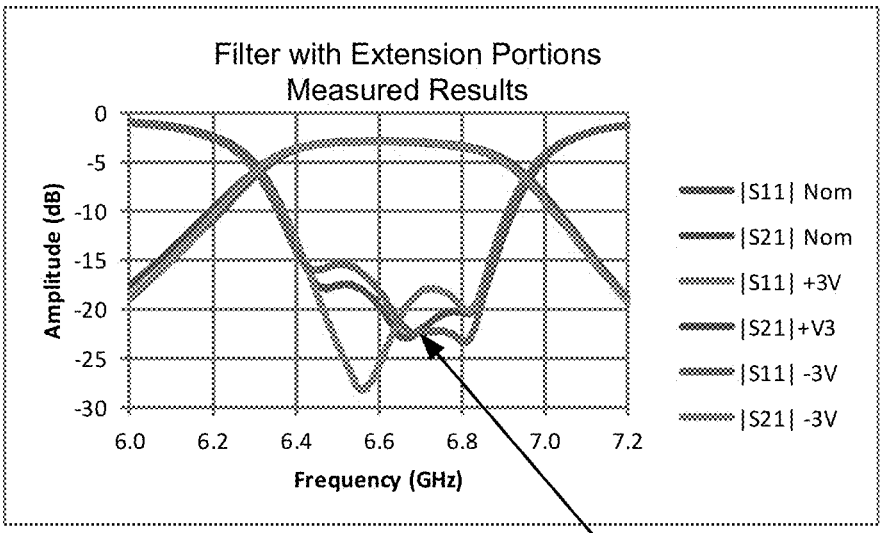
FIG. 11A illustrates a measured response involving operation of the filter in FIG. 10.

FIG. 11 A shows a graph of measured response results for the example filter 700 illustrated in FIG. 10. Similar to Graph B of FIG. 11, the graph of FIG. 11A illustrates, as compared to Graph A, a reduction in variation of response (e.g., shown near 771) between filters with a slight registration error in either direction (e.g., either −3 mils or +3 mils).

As noted herein, some embodiments of the present invention attempt to reduce registration error that may occur due to misaligned communication positions for communication features in a metallization layer structure (e.g., a resonator element). In some embodiments, a resonator element may be designed with an error limiting feature with symmetrically disposed communication features having offsetting effects to reduce the effects of any registration error. Along similar lines, in some embodiments, a resonator element may be designed with an error limiting features that creates a deviation (e.g., a lack of straight path) between the first end of the resonator element and the communication position for the communication feature to reduce the effects of changes in radio frequency characteristics of the resonator element due to registration error.

Figure 12:
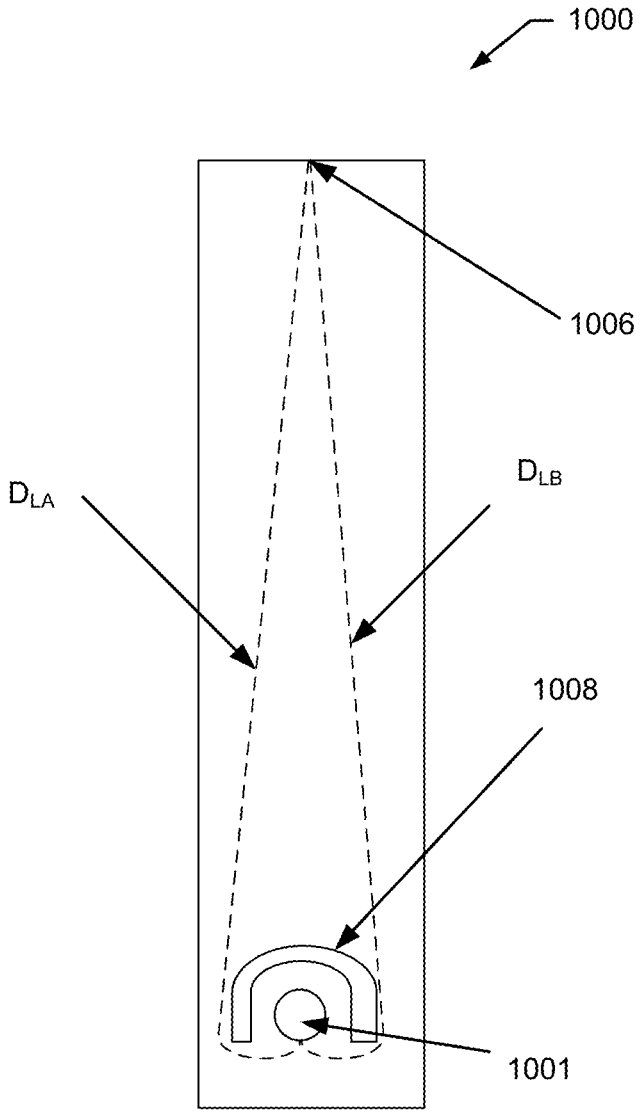
FIG. 12 illustrates another example resonator element according to various example embodiments.
Figure 12A:
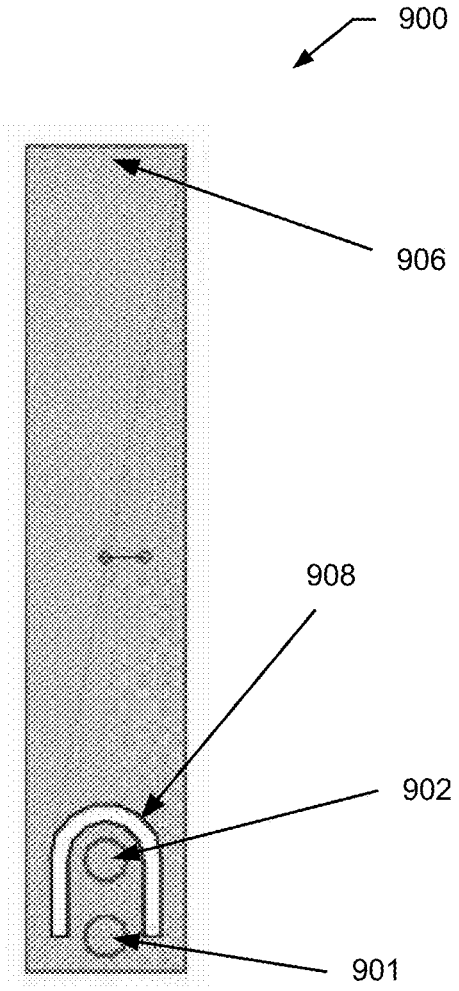
FIG. 12A illustrates another example resonator element according to various example embodiments.

FIGS. 12 and 12A illustrate example conductive layer (e.g., resonator elements 1000, 900, respectively) that define an error limiting feature designed to create a deviation (e.g., a lack of straight imaginary path) between a first end of the conductive layer and the communication position for the communication feature to reduce the effects of registration error. In the depicted embodiments, the error limiting feature defines a cut-out portion that defines an area of the conductive layer that has been removed. For example, as noted above, an imaginary path may be defined between a first end of the conductive layer and the communication position for the communication feature to at least partially reduce effects on radio frequency characteristics by a deviation in the imaginary path.

As illustrated in FIG. 12, the resonator element 1000 includes a cut-out portion 1008 that defines an upside down "U" shape. In the depicted embodiment, the resonator element 1000 includes a first communication feature 1001. The communication feature 1001 is positioned between the cut-out portion 1008 and a first end 1006 of the resonator element 1000. In such a manner, the resonator element 1000 is designed such that there is no direct imaginary path between the first end 1006 and the communication position for the communication feature 1001. For example, the imaginary path (equated to the effective length of the resonator element 1000) follows the lines "$D_{LA}$" and "$D_{LB}$" shown in FIG. 12 around the cut-out portion 1008.

Similarly, FIG. 12A illustrates a resonator element 900 that also includes a cut-out portion 908 that defines an upside down "U" shape. In the depicted embodiment, however, the resonator element 900 includes a first communication feature 901 and a second communication feature 902. Both communication features 901, 902 are positioned between the cut-out portion 908 and a first end 906 of the resonator element 900. Thus, similar to the resonator element 1000, a non-direct imaginary path is formed.

By positioning a cut-out portion, such as one of the cut-out portions depicted in FIG. 12, the resonator element structure can reduce the effect of registration errors in the longitudinal direction because the errors may generate a reduced effect due to the geometry by placing the communication feature 1001 near the end of the cut-out portion (e.g., in a similar manner to an extension portion as described with regard to FIG. 2C). Additionally, by defining the cut-out portion on both sides of the communication feature, registration errors in the lateral direction may also be accounted for. For example, a registration error of −2 mils in the lateral direction will create a shorter effective length on the left side of the communication feature, but will also create a longer effective length on the right side of the communication feature. Thus, with a single communication feature, lateral variations can be reduced even in the absence of consistent registration error.

Along these same lines, the use of a cut-out portion, such as in the example embodiments shown in FIGS. 12 and 12A, allows for similar benefits without an extended footprint for the resonator element (i.e., as compared to the footprint of the embodiments of, for example, FIGS. 3-6, which each define extension portions). For example, the example resonator elements 900 and 1000 have a smaller footprint, i.e., without an extension portion, when compared to the example resonator element of FIG. 2, which includes extension portion 204. Though shown as a "U" shape, the cut-out portion of some embodiments of the present invention may be any shape.

Figure 13:
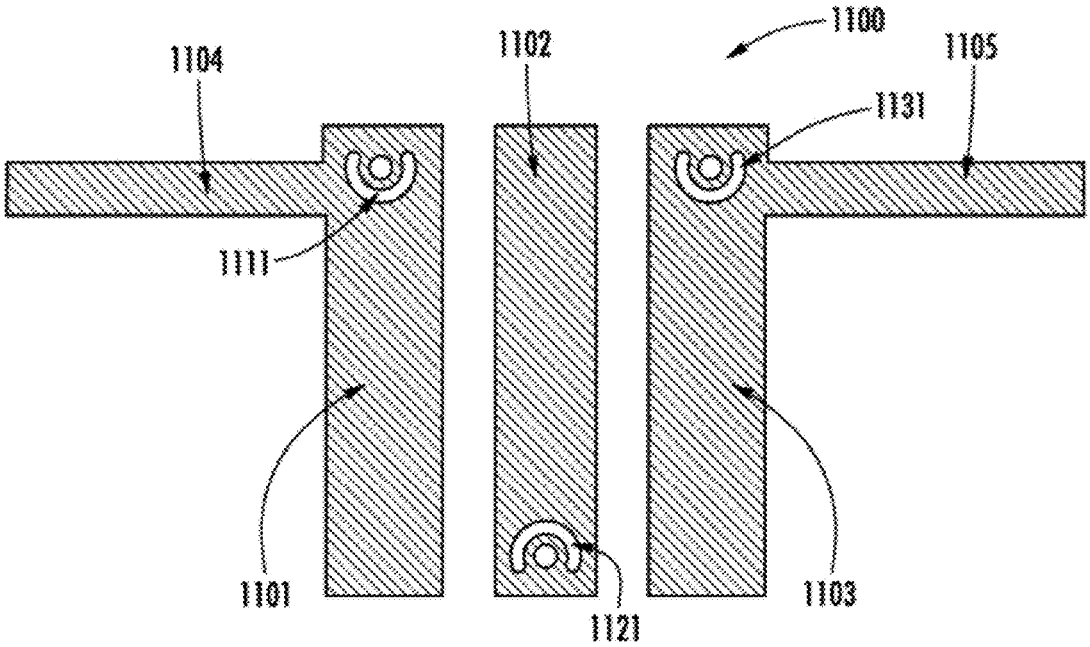
FIG. 13 illustrates an example filter according to various example embodiments.

FIG. 13 illustrates an example embodiment in the form of a collection of resonator elements similar to those shown in FIG. 12 to form an interdigital filter 1100. As depicted in FIG. 13, filter 1100 may include resonator elements 1101, 1102, and 1103. Resonator element 1101 has a similar architecture to resonator element 1000, with the addition of a port 1104. The resonator element 1103 may be an inversion of the resonator element 1101 with a port 1105. Additionally, each resonator element 1101, 1102, 1103 may include a cut-out portion 1111, 1121, 1131 respectively, which is designed to create a deviation (e.g., a lack of straight imaginary path) between a first end of the resonator element and the communication position of the communication feature to reduce the effects registration error. Thus, changes in the imaginary path distance due to registration error may be at least partially offset by the deviation in the imaginary path created by cut-out portions 1111, 1121, and 1131.

Figure 14:
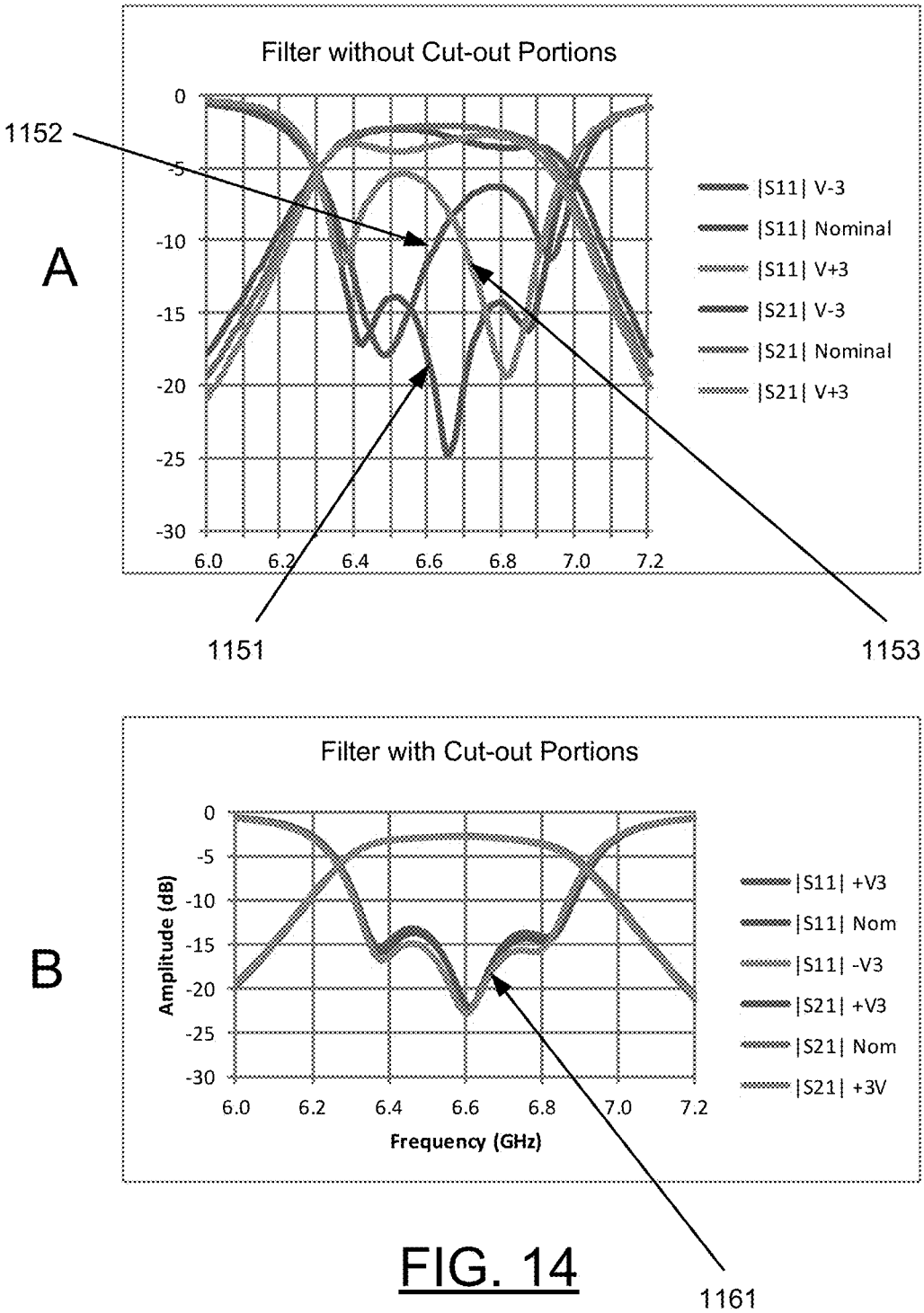
FIG. 14 illustrates a response comparison involving operation of the filter in FIG. 13 relative to a conventional filter.

FIG. 14 provides graphs A and B that compare the response of a conventional interdigital filter at 6.55 GHz with a bandwidth of about 500 MHz (Graph A), with one using a design similar to example filter 1100 illustrated in FIG. 13 which includes an error limiting feature of a cut-out portion (Graph B). Results of simulations using Ansoft HFSS of three conventional filters and three filters with the error limiting feature have been shown. One conventional filter and one filter with the error limiting feature has no registration error and other two conventional filters and filters with error limiting features include registration errors of 3 mils in the + and − longitudinal direction. In particular, Graphs A and B show input return loss ("S11") and insertion loss ("S21") of each of the three conventional filters and each of the three filters with an error limiting feature. As indicated in the graphs, the variations in Graph A are greatly reduced with the example embodiment structure as provided in Graph B.

For example, with reference to Graph A, the conventional filter may have a response 1151 for a filter with no registration error (e.g., the communication position was properly placed in the designed position). However, as shown in Graph A, a slight registration error of −3 mils creates a response 1152 that is different than the intended response 1151. Similarly, a slight registration error of +3 mils creates a response 1153 that is different than the intended response 1151. In contrast, with reference to Graph B, a slight registration error in either direction (e.g., either −3 mils or +3 mils) presents less variation in the response (e.g., shown near 1161).

Figure 14A:
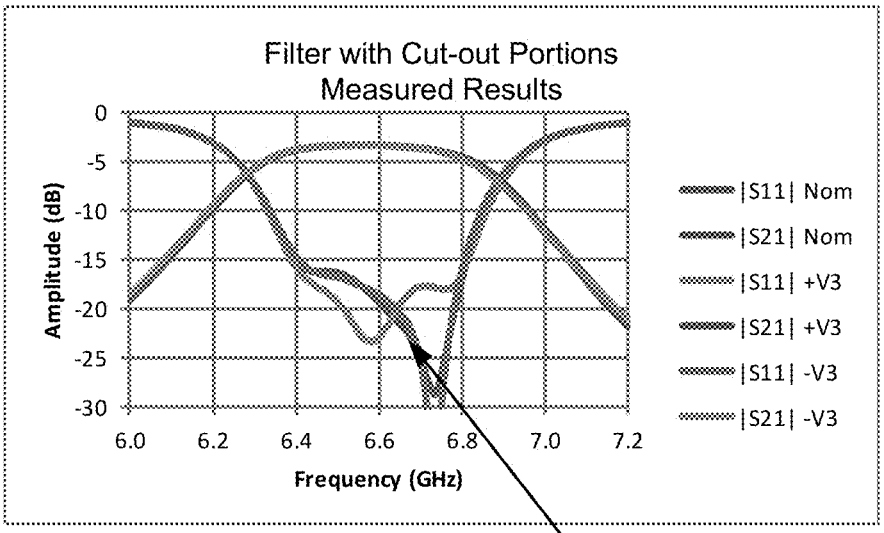
FIG. 14A illustrates a measured response involving operation of the filter in FIG. 13.

FIG. 14A shows a graph of measured response results for the example filter 1100 illustrated in FIG. 13. Similar to Graph B of FIG. 14, the graph of FIG. 14A illustrates, as compared to Graph A, a reduction in variation of response (e.g., shown near 1171) between filters with a slight registration error in either direction (e.g., either −3 mils or +3 mils).

Figure 15:
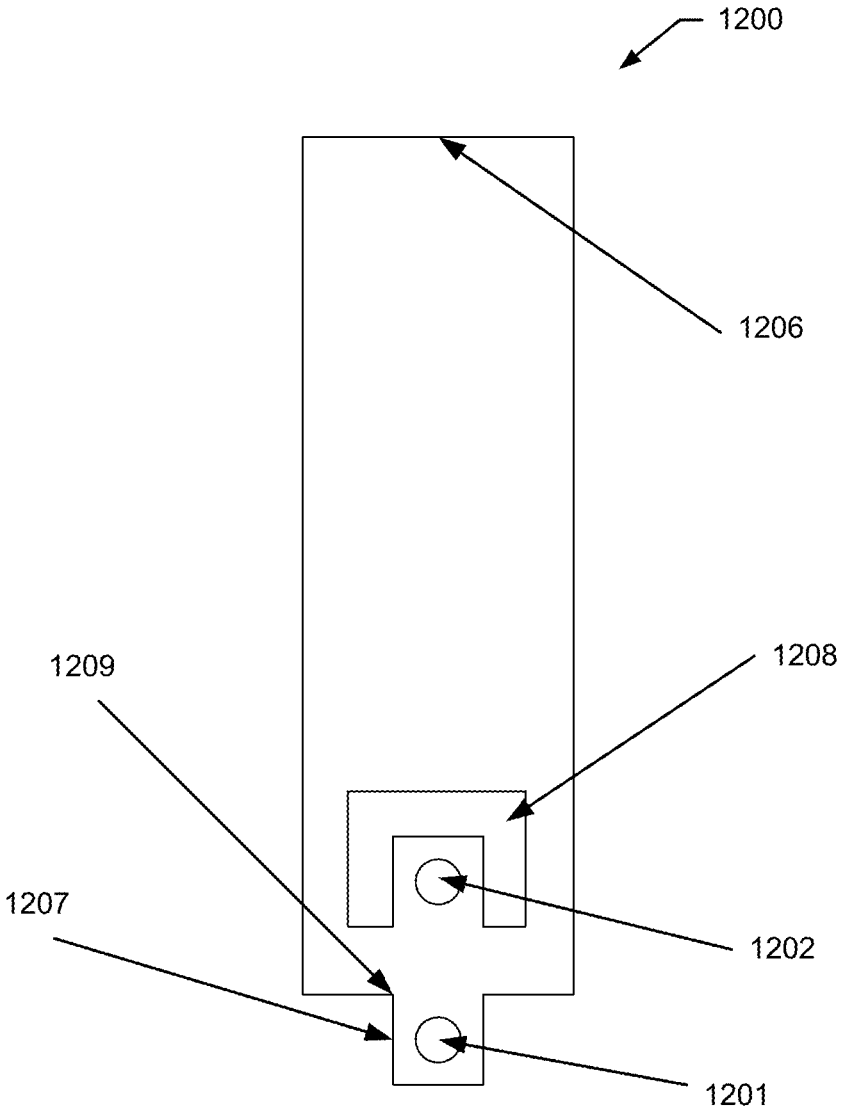
FIG. 15 illustrates another example resonator element according to various example embodiments.

FIG. 15 illustrates another example metallization layer structure (e.g., resonator element 1200) designed to create a deviation (e.g., a lack of straight path) between a first end 1206 of the resonator element 1200 and the communication positions of the communication features 1201, 1202 to reduce the effects of registration error. In the depicted embodiment, the resonator element 1200 includes two error limiting features. For example, the resonator element 1200 includes a cut-out portion 1208 and an extension portion 1207. The extension portion 1207 extends longitudinally out from the footprint of the resonator element 1200 (e.g., longitudinally outward from an edge 1209 of the resonator element structure 1200). The resonator element 1200 includes a first communication feature 1201 on the extension portion 1207 and a second communication feature 1202 positioned between the cut-out portion 1208 and a first end 1206 of the resonator element structure 1200. Thus, changes in the imaginary path distance due to registration error may be at least partially offset by the deviation in the imaginary path created by the cut-out portion 1208 and the geometry of the communication positions of the first and second communication features 1201, 1202. Such an embodiment may further reduce changes in radio frequency characteristics in the resonator element due to registration error.

In some embodiments, the resonator element may include a wider end near the communication feature (e.g., the portion of the resonator element structure near the communication feature may extend laterally outward from the original footprint of the resonator element). For example, any of the resonator elements with a cut-out portion (e.g., the resonator elements shown in FIGS. 12, 12A, 13, and 15) may benefit from the widening of the second end (e.g., a lateral extension) near the cut-out portion, such as may compensate for any loss from the resonator element being narrower at the point where resonance current is the highest.

In some embodiments, a method for manufacturing a resonator may be provided. In such embodiments, the method may include providing a resonator with a first conductive layer and a second conductive layer as described in any embodiments herein. Additionally, the method may further include forming at least one communication feature, according to any embodiment, or combination of embodiments, described herein.

As such, the example embodiments described herein provide for use of an error limiting feature on a conductive layer for reduction of changes in radio frequency characteristics of the conductive layer due to registration error. Indeed, as described herein, the error limiting feature may reduce changes in radio frequency characteristics due to registration error in a number of ways.

For example, an error limiting feature defining an extension portion enables positioning of the communication position and corresponding communication features in a symmetrical pattern to reduce changes in radio frequency characteristics from registration error in the circumstance of consistent misplacement of the communication features. If the communication position and communication features are positioned symmetrically on the extension portion with respect to a central axis of the conductive layer than the effects of consistent misplacement in the lateral direction may be offset and thereby reduced (e.g., shown in FIG. 2B). Additionally, however, if the communication position and communication features are positioned symmetrically on the extension portion in the longitudinal direction (e.g., shown in FIG. 3) then the same principal of consistent misplacement can be applied and the effects of such consistent misplacement in the longitudinal direction may be offset so as to reduce changes in radio frequency characteristics of the conductive layer.

Another example way that an error limiting feature may reduce changes in radio frequency characteristics due to registration error is illustrated and described with respect to FIGS. 2A and 2C. In particular, use of an error limiting feature defining an extension portion and positioning of the communication position and corresponding communication features on the extension portion may cause reduction to changes in radio frequency characteristics from registration error due to the geometry now used for defining the effective length of the conductive layer. For example, with reference to FIG. 2A, by causing the effective length (e.g., a representation of the electrical current path) to "turn the corner" on the extension portion, any misplacement in the longitudinal direction may cause less of a change in the overall length of the effective length and, thus, cause less of an effect on changes to the radio frequency characteristics of the conductive layer. To further enhance the effectiveness of the reduction in changes to the radio frequency characteristics of the conductive layer due to misplacement in the longitudinal direction, the communication positions (and corresponding communication features) may, in some cases, with reference to FIG. 2C, be positioned further upward such that the effective length "turns the corner" to a further degree on the extension portion. This reduction in sensitivity to registration error through geometry can, in some cases, be obtained by placing the nominal communication position of a communication feature at or near a point of frequency extremum of a conductive layer.

A further example way that an error limiting feature may reduce changes in radio frequency characteristics due to registration error is illustrated and described with respect to FIG. 12. In particular, use of an error limiting feature that defines a cut-out portion positioned between the first end of the conductive layer and the communication position (and communication feature) may cause reduction in changes to the radio frequency characteristics due to the symmetry of the cut-out portion and the geometry used for defining the effective length. For example, with reference to FIG. 12, the cut-out portion 1008 may be symmetrically defined with respect to the central axis of the resonator element 1000. Additionally, the cut-out portion 1008 may extend up to and, in some cases, beyond the communication feature 1001. In such manner, the effective length (e.g., a representation of the electrical current path) may run on both sides (e.g., see lines $D_{LA}$ and $D_{LB}$) such that any misplacement of the communication feature in the lateral direction will be offset (similar to the symmetrical positioning of the communication features 201, 202 in FIG. 2B) and have a reduced effect on changes to the radio frequency characteristics of the conductive layer. Additionally, however, any misplacement of the communication feature 1001 in the longitudinal direction will be accounted for by the geometry of the effective length as created by the cut-out portion 1008. Indeed, by causing the effective length (e.g., a representation of the electrical current path) to "turn the corner" around the cut-out portion, any misplacement in the longitudinal direction may cause less of a change in the overall length of the effective length and, thus, cause less of an effect on changes to the radio frequency characteristics of the conductive layer (e.g., similar to FIGS. 2A and 2C).

As mentioned above, the techniques described herein may also be useful for features other than filter elements, and for applications well beyond UWB devices. Microwave circuitry, for example, may include many types of matching and tuning elements which are more commonly being printed with any of various planar processes. Additionally, higher frequency solutions may have circuits and structures built on GaAs (Gallium Arsenide) and smaller sizes. Along these same lines, the techniques described herein may be useful for any resonant structure (e.g., notch filters, high pass filters, etc.).

With the trend toward higher and higher operating frequencies, the structures and techniques described herein may be used to achieve more consistency from inexpensive fabrication technologies. The example embodiments descried herein may also be applicable with solder bumps (as opposed to vias) that are implemented on flip-chip and similar technologies, where the solder bumps are positioned to electrically connect layers of separate boards or chips. For example, solder bumps on the top surface of a lower board may be configured to align with receiving positions on the bottom surface of an upper board. The solder bumps may be aligned to connect structures between boards and layers of boards. In addition to solder bumps, plated bumps may be used, where a chemical (e.g., electrolysis) process may be performed to designate the position of the plated bumps. Other forms of connectors may also include stub bumps and adhesive bumps.

Accordingly, various example embodiments may be applied in a variety of settings where electrical connectors are positioned relative to structures on a substrate or between substrates, for example, in a face-to-face configuration. As such, the example embodiments described herein, while being described with respect to the use of vias, may be implemented more generally within the context of any type of electrical connection points.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments are not to be limited to those specifically disclosed and that modifications and other embodiments are intended to be included within the scope of the application. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the application. In this regard, for example, different combinations of elements and/or functions other than those explicitly described above are also contemplated as may be set forth in claims to the some or all of the embodiments. Although specific terms are employed herein, they are used in a generic and descriptive sense only and not for purposes of limitation.

What is claimed is:

1. A resonator comprising:

a first conductive layer defining an error limiting feature, wherein the first conductive layer defines a first end and an opposing second end, and a first lateral edge and an opposing second lateral edge, wherein the error limiting feature of the first conductive layer defines an extension portion proximate the second end that extends laterally from the first lateral edge;

a second conductive layer; and at least one communication feature configured to electrically couple the first conductive layer and the second conductive layer at least one communication position, wherein each at least one communication position is positioned on the extension portion at a point of frequency extremum so as to reduce changes in radio frequency characteristics of the resonator due to registration error regardless of the position of any other communication position.

2. The resonator according to claim 1, wherein the error limiting feature is defined by the first conductive layer between the communication position and the first end.

3. The resonator according to claim 1, wherein the extension portion extends laterally from the first lateral edge and the second lateral edge, the at least one communication feature comprises a first communication feature and a second communication feature, the at least one communication position comprises first and second communication positions the first communication feature is configured to electrically couple the first conductive layer to the second conductive layer at the first communication position, the second communication feature is configured to electrically couple the first conductive layer to the second conductive layer at the second communication position, and the first communication position and the second communication position are positioned on the extension portion.

4. The resonator according to claim 3, wherein the first communication position and the second communication position are positioned at proximate opposite ends of the extension portion in the lateral direction on the first conductive layer.

5. The resonator according to claim 3, wherein the first communication position and the second communication position are positioned symmetrically in the lateral direction on the first conductive layer.

6. The resonator according to claim 3, wherein the first communication position and the second communication position are positioned asymmetrically in a longitudinal direction on the first conductive layer that is defined between the first end and the second end.

7. The resonator according to claim 1, wherein the extension portion further defines at least one tab that extends longitudinally in at least one direction from an edge of the at least one extension portion, and wherein the communication position is positioned at least partially on the at least one tab.

8. The resonator according to claim 1, wherein the extension portion is defined such that a radiused transition exists between the extension portion and the first lateral edge of the first conductive layer to increase durability and consistent formation of the resonator and the extension portion during etching.

9. The resonator according to claim 1, wherein the second conductive layer comprises a ground plane.

10. A filter including the resonator according to claim 1, wherein the first conductive layer further comprises second and third resonators, and wherein the resonator and the second and third resonators are arranged to form the filter.

11. The resonator according to claim 1, wherein the extension portion defines a first portion and a second portion, wherein the first portion defines a top edge that extends laterally from the first lateral edge of the resonator at a first longitudinal distance from the second end of the resonator, wherein the second portion extends longitudinally above the top edge of the first portion, and wherein the at least one communication position is positioned at least partially on the second portion such that a center point of the at least one communication position is a second longitudinal distance from the second end of the resonator that is greater than the first longitudinal distance.

12. The resonator according to claim 11, wherein the resonator defines an effective length extending from the first end of the resonator to the at least one communication position, and wherein the at least one communication position is positioned on the extension portion to cause the effective length to turn a corner between the first portion and the second portion of the extension portion.

13. The resonator according to claim 1, wherein the extension portion defines a first portion below the at least one communication position and a second portion above the at least one communication position, and wherein the first portion is larger than the second portion.

14. A filter comprising:

a first conductive layer comprising a first resonator element defining a first end, opposing lateral edges, and a first error limiting feature, wherein the first error limiting feature defines a first extension portion proximate the first end that extends laterally from a lateral edge, and a second resonator element defining a first end, opposing lateral edges, and a second error limiting feature, wherein the second error limiting feature defines a second extension portion proximate the first end that extends laterally from a lateral edge;

a second conductive layer defining a ground plane;

a first communication feature configured to electrically couple the first resonator element to the ground plane at a first communication position, wherein the first communication position is positioned on the first extension portion at a point of frequency extremum so as to reduce changes in radio frequency characteristics of the first resonator element due to registration error regardless of the position of any other communication position on the first resonator element; and a second communication feature configured to electrically couple the second resonator element to the ground plane at a second communication position, wherein the second communication position is positioned on the second extension portion at a point of frequency extremum so as to reduce changes in radio frequency characteristics of the second resonator element due to registration error regardless of the position of any other communication position on the second resonator element.

15. The filter according to claim 14, wherein:

the first conductive layer further comprises a third resonator element defining a first end and a third error limiting feature, and a third communication feature, the third communication feature is configured to electrically couple the third resonator element to the ground plane at a third communication position, and the third error limiting feature is defined by the third resonator element between the third communication position and the first end of the third resonator element.

16. A first conductive layer comprising:

a first end and an opposing second end and a first lateral edge and an opposing second lateral edge; and an error limiting feature configured to reduce changes in radio frequency characteristics of the first conductive layer due to registration error, wherein the error limiting feature defines an extension portion proximate the second end that extends laterally from the first lateral edge, wherein the first conductive layer is configured to electrically couple with a second conductive layer through at least one communication feature at least one communication position, and wherein each at least one communication position is positioned on the extension portion at a point of frequency extremum so as to reduce said changes in the radio frequency characteristics of the first conductive layer due to said registration error regardless of the position of any other communication position.

17. The first conductive layer according to claim 16, wherein the error limiting feature is defined by the first conductive layer between the communication position and the first end.

18. The first conductive layer according to claim 16, wherein the at least one communication feature comprises a first communication feature and a second communication feature, the at least one communication position comprises first and second communication positions wherein the first communication feature is configured to electrically couple the first conductive layer and the second conductive layer at the first communication position, wherein the second communication feature is configured to electrically couple the first conductive layer and the second conductive layer at the second communication position, and wherein the first communication position and the second communication position are positioned on the extension portion.

19. The first conductive layer according to claim 18, wherein the first communication position and the second communication position are positioned symmetrically in a lateral direction on the first conductive layer.

20. The first conductive layer according to claim 18, wherein the first communication position and the second communication position are positioned proximate opposite ends of the extension portion in a lateral direction on the first conductive layer.

21. The first conductive layer according to claim 18, wherein the first communication position and the second communication position are positioned asymmetrically in a longitudinal direction on the first conductive layer that is defined between the first end and the second end.

22. The first conductive layer according to claim 16, wherein the extension portion further defines at least one tab that extends longitudinally in at least one direction from an edge of the extension portion, and wherein the at least one communication position is positioned at least partially on the at least one tab.

23. The first conductive layer according to claim 16, wherein the extension portion is defined such that a radiused transition exists between the extension portion and the first lateral edge of the first conductive layer to increase durability and consistent formation of the resonator and the extension portion during etching.

24. The first conductive layer according to claim 16, wherein the extension portion defines a first portion and a second portion, wherein the first portion defines a top edge that extends laterally from the first lateral edge of the first conductive layer at a first longitudinal distance from the second end of the first conductive layer, wherein the second portion extends longitudinally above the top edge of the first portion, and wherein the at least one communication position is positioned at least partially on the second portion such that a center point of the at least one communication position is a second longitudinal distance from the second end of the first conductive layer that is greater than the first longitudinal distance.

25. The first conductive layer according to claim 24, wherein the first conductive layer defines an effective length extending from the first end of the first conductive layer to the at least one communication position, and wherein the at least one communication position is positioned on the extension portion to cause the effective length to turn a corner between the first portion and the second portion of the extension portion.

26. The first conductive layer according to claim 16, wherein the extension portion defines a first portion below the communication position and a second portion above the communication position, and wherein the first portion is larger than the second portion.

27. A method of manufacturing a resonator, the method comprising:

providing a first conductive layer, wherein the first conductive layer defines an error limiting feature configured to reduce changes in radio frequency characteristics of the resonator due to registration error, wherein the first conductive layer defines a first end and an opposing second end and a first lateral edge and an opposing second lateral edge, wherein the error limiting feature of the first conductive layer defines an extension portion proximate the second end that extends laterally from the first lateral edge;

providing a second conductive layer; and forming at least one communication feature, wherein the at least one communication feature is configured to electrically couple the first conductive layer and the second conductive layer at at least one communication position, wherein the communication position is positioned on the extension portion at a point of frequency extremum so as to reduce said changes in the radio frequency characteristics of the first conductive layer due to said registration error regardless of the position of any other communication position.

28. The method according to claim 27, wherein forming the at least one communication feature comprises forming the at least one communication feature in the communication position such that the error limiting feature is defined by the first conductive layer between the communication position and the first end.

29. The method according to claim 27, wherein the extension portion extends laterally from the first lateral edge and the second lateral edge, and wherein forming the at least one communication feature comprises forming a first communication feature and a second communication feature, and the at least one communication position comprises first and second communication positions, wherein the first communication feature is configured to electrically couple the first conductive layer to the second conductive layer at the first communication position, wherein the second communication feature is configured to electrically couple the first conductive layer to the second conductive layer at the second communication position, and wherein the first communication position and the second communication position are positioned on the extension portion.

30. The method according to claim 29, wherein the first communication position and the second communication position are positioned proximate opposite ends of the extension portion in a lateral direction on the first conductive layer.

31. The method according to claim 29, wherein the first communication position and the second communication position are positioned symmetrically in a lateral direction on the first conductive layer.

32. The method according to claim 29, wherein the first communication position and the second communication position are positioned asymmetrically in a longitudinal direction on the first conductive layer that is defined between the first end and the second end.

33. The method according to claim 27, wherein the extension portion further defines at least one tab that extends longitudinally in at least one direction from an edge of the extension portion, and wherein the at least one communication position is positioned at least partially on the at least one tab.

34. The method according to claim 27, wherein the extension portion is defined such that a radiused transition exists between the extension portion and the first lateral edge of the first conductive layer to increase durability and consistent formation of the resonator and the extension portion during etching.

35. The method according to claim 27, wherein the extension portion defines a first portion and a second portion, wherein the first portion defines a top edge that extends laterally from the first lateral edge of the resonator at a first longitudinal distance from the second end of the resonator, wherein the second portion extends longitudinally above the top edge of the first portion, and wherein the at least one communication position is positioned at least partially on the second portion such that a center point of the at least one communication position is a second longitudinal distance from the second end of the resonator that is greater than the first longitudinal distance.

36. The method according to claim 35, wherein the resonator defines an effective length extending from the first end of the resonator to the at least one communication position, and wherein the at least one communication position is positioned on the extension portion to cause the effective length to turn a corner between the first portion and the second portion of the extension portion.

37. The method according to claim 27, wherein the extension portion defines a first portion below the at least one communication position and a second portion above the at least one communication position, and wherein the first portion is larger than the second portion.

38. A resonator comprising:

a first conductive layer defining an error limiting feature, wherein the first conductive layer defines a first end and a second end disposed opposite the first end in a longitudinal direction of the first conductive layer, and a first lateral edge and a second lateral edge disposed opposite the first lateral edge in a lateral direction of the first conductive layer, wherein the error limiting feature of the first conductive layer defines an extension portion proximate the second end that extends laterally from the first lateral edge;

a second conductive layer;

a first communication feature configured to electrically couple the first conductive layer and the second conductive layer at a first communication position, wherein the first communication position is positioned on the extension portion, wherein the first communication position is positioned a first longitudinal distance in the longitudinal direction from the second end of the resonator prior to occurrence of registration error; and a second communication feature configured to electrically couple the first conductive layer and the second conductive layer at a second communication position, wherein the second communication position is positioned a second longitudinal distance in the longitudinal direction from the second end of the resonator prior to occurrence of said registration error, wherein the first longitudinal distance is greater than the second longitudinal distance such that changes in radio frequency characteristics of the resonator due to said registration error are reduced.

39. The resonator of claim 38, wherein said changes in the radio frequency characteristics of the resonator due to said registration error in the longitudinal direction are reduced.

40. The resonator of claim 38, wherein the second communication position is positioned on the extension portion.

41. The resonator of claim 38, wherein the error limiting feature of the first conductive layer further defines a second extension portion proximate the second end that extends laterally from the second lateral edge of the resonator, wherein the resonator defines a third communication feature configured to electrically couple the first conductive layer and the second conductive layer at a third communication position, wherein the third communication position is positioned on the second extension portion.

42. The resonator of claim 41, wherein the second communication position is positioned on the extension portion, wherein the third communication position is positioned a third longitudinal distance in the longitudinal direction from the second end of the resonator, wherein the resonator defines a fourth communication feature configured to electrically couple the first conductive layer and the second conductive layer at a fourth communication position, wherein the fourth communication position is positioned on the second extension portion at a fourth longitudinal distance in the longitudinal direction from the second end of the resonator, and wherein the third longitudinal distance is greater than the fourth longitudinal distance such that said changes in the radio frequency characteristics of the resonator due to said registration error are reduced.

43. A filter including the resonator according to claim 38, wherein the first conductive layer further comprises second and third resonators, and wherein the resonator and the second and third resonators are arranged to form the filter.

44. A first conductive layer comprising:

a first end and a second end disposed opposite the first end in a longitudinal direction of the first conductive layer and a first lateral edge and a second lateral edge disposed opposite the first lateral edge in a lateral direction of the first conductive layer; and an error limiting feature configured to reduce changes in radio frequency characteristics of the first conductive layer due to registration error, wherein the error limiting feature defines an extension portion proximate the second end that extends laterally from the first lateral edge, wherein the first conductive layer is configured to electrically couple with a second conductive layer through a first communication feature at a first communication position positioned on the extension portion, wherein the first communication position is positioned a first longitudinal distance in the longitudinal direction from the second end of the first conductive layer prior to occurrence of said registration error, and wherein the first conductive layer is further configured to electrically couple with the second conductive layer through a second communication feature at a second communication position positioned a second longitudinal distance in the longitudinal direction from the second end of the first conductive layer prior to occurrence of said registration error, wherein the first longitudinal distance is greater than the second longitudinal distance such that said changes in the radio frequency characteristics of the resonator due to said registration error are reduced.

45. The first conductive layer of claim 44, wherein said changes in the radio frequency characteristics of the resonator due to said registration error in the longitudinal direction are reduced.

46. The first conductive layer of claim 44, wherein the second communication position is positioned on the extension portion.

47. The first conductive layer of claim 44, wherein the error limiting feature further defines a second extension portion proximate the second end that extends laterally from the second lateral edge of the first conductive layer, wherein the first conductive layer is further configured to electrically couple with the second conductive layer through a third communication feature at a third communication position positioned on the second extension portion.

48. The first conductive layer of claim 47, wherein the second communication position is positioned on the extension portion, wherein the third communication position is positioned a third longitudinal distance in the longitudinal direction from the second end of the first conductive layer, wherein the first conductive layer is further configured to electrically couple with the second conductive layer through a fourth communication feature at a fourth communication position positioned on the second extension portion at a fourth longitudinal distance in the longitudinal direction from the second end of the first conductive layer, and wherein the third longitudinal distance is greater than the fourth longitudinal distance such that said changes in the radio frequency characteristics of the resonator due to said registration error are reduced.

49. A method of manufacturing a resonator, the method comprising:

providing a first conductive layer, wherein the first conductive layer defines an error limiting feature configured to reduce changes in radio frequency characteristics of the resonator due to registration error, wherein the first conductive layer defines a first end and a second end disposed opposite the first end in a longitudinal direction of the first conductive layer and a first lateral edge and a second lateral edge disposed opposite the first lateral edge in a lateral direction of the first conductive layer, wherein the error limiting feature of the first conductive layer defines an extension portion proximate the second end that extends laterally from the first lateral edge;

providing a second conductive layer;

forming a first communication feature configured to electrically couple the first conductive layer and the second conductive layer at a first communication position, wherein the first communication position is positioned on the extension portion, wherein the first communication position is positioned a first longitudinal distance in the longitudinal direction from the second end of the resonator prior to occurrence of said registration error; and forming a second communication feature configured to electrically couple the first conductive layer and the second conductive layer at a second communication position, wherein the second communication position is positioned a second longitudinal distance in the longitudinal direction from the second end of the resonator prior to occurrence of said registration error, wherein the first longitudinal distance is greater than the second longitudinal distance such that said changes in the radio frequency characteristics of the resonator due to said registration error are reduced.

50. The method of claim 49, wherein said changes in the radio frequency characteristics of the resonator due to said registration error in the longitudinal direction are reduced.

51. The method of claim 49, wherein the second communication position is positioned on the extension portion.

52. The method of claim 49, wherein the error limiting feature of the first conductive layer further defines a second extension portion proximate the second end that extends laterally from the second lateral edge of the resonator, wherein the method further comprises forming a third communication feature configured to electrically couple the first conductive layer and the second conductive layer at a third communication position, wherein the third communication position is positioned on the second extension portion.

53. The method of claim 52, wherein the second communication position is positioned on the extension portion, wherein the third communication position is positioned a third longitudinal distance in the longitudinal direction from the second end of the resonator, wherein the method further comprises forming a fourth communication feature configured to electrically couple the first conductive layer and the second conductive layer at a fourth communication position, wherein the fourth communication position is positioned on the second extension portion at a fourth longitudinal distance in the longitudinal direction from the second end of the resonator, and wherein the third longitudinal distance is greater than the fourth longitudinal distance such that said changes in the radio frequency characteristics of the resonator due to said registration error are reduced.

* * * * *